US010032403B2

(12) United States Patent
Matsueda et al.

(10) Patent No.: US 10,032,403 B2
(45) Date of Patent: Jul. 24, 2018

(54) ELECTRO OPTICAL DEVICE, ELECTRIC APPARATUS AND PIXEL RENDERING METHOD

(71) Applicant: NLT TECHNOLOGIES, LTD., Kawasaki, Kanagawa (JP)

(72) Inventors: Yojiro Matsueda, Kawasaki (JP); Keita Hamada, Kawasaki (JP)

(73) Assignee: NLT TECHNOLOGIES, LTD., Kawasaki, Kanagawa (JP)

( * ) Notice: Subject to any disclaimer, the term of this patent is extended or adjusted under 35 U.S.C. 154(b) by 114 days.

(21) Appl. No.: 15/047,771

(22) Filed: Feb. 19, 2016

(65) Prior Publication Data

US 2016/0247441 A1 Aug. 25, 2016

(30) Foreign Application Priority Data

Feb. 20, 2015 (JP) ..... 2015-031466

(51) Int. Cl.
*G09G 3/30* (2006.01)
*G09G 3/3233* (2016.01)
*G09G 3/20* (2006.01)

(52) U.S. Cl.
CPC ..... *G09G 3/2003* (2013.01); *G09G 3/2059* (2013.01); *G09G 3/3233* (2013.01);
(Continued)

(58) Field of Classification Search
CPC .. G09G 3/2003; G09G 3/2059; G09G 3/3233; G09G 2300/0443;
(Continued)

(56) References Cited

U.S. PATENT DOCUMENTS 4,586,037 A * 4/1986 Rosener ..... G06K 15/02 345/418
7,580,093 B2 * 8/2009 Rho ..... G02F 1/133514 349/108

(Continued)

FOREIGN PATENT DOCUMENTS

WO WO 2011/067699 A1 * 6/2011

OTHER PUBLICATIONS

Woo-Young So et al., "Power Efficient AMOLED Display with Novel Four Sub-Pixel Architecture and Driving Scheme", SID 10 Digest, 2010, pp. 622-625, 43.3.

*Primary Examiner* — Julie Anne Watko
(74) *Attorney, Agent, or Firm* — Sughrue Mion, PLLC

(57) ABSTRACT

An electro optical device has a pixel array constituted by pixels arranged in matrix, each pixel including four subpixels, the four subpixels including RGB subpixels and a subpixel of a similar color to a specific color among RGB, and the four subpixels being arranged in two rows and two columns. In each pixel, a first subpixel having the highest emission luminance and a second subpixel having the second highest emission luminance among subpixels needed for white display are arranged on one diagonal line of the pixel, and the other subpixels are arranged on the other diagonal line. The electro optical device has a control unit that executes switching between a first driving condition and a second driving condition in accordance with a color of a pixel to be displayed, the first driving condition in which both the subpixel of the specific color and the subpixel of the similar color are driven to emit light with the first luminance ratio, and the second driving condition in which both the subpixels of the specific color and the similar color are driven to emit light with the second luminance ratio.

10 Claims, 39 Drawing Sheets

ERROR DIFFUSION TYPE A
(PARTICULARLY ADDRESSING COLOR EDGE PREVENTION)

ERROR DIFFUSION TYPE B
(PARTICULARLY ADDRESSING SHARPNESS)

(52) U.S. Cl.
CPC ... *G09G 3/2044* (2013.01); *G09G 2300/0443* (2013.01); *G09G 2320/0242* (2013.01); *G09G 2320/045* (2013.01); *G09G 2320/0666* (2013.01); *G09G 2320/103* (2013.01); *G09G 2340/0457* (2013.01)

(58) Field of Classification Search
CPC ..... G09G 2320/0242; G09G 2320/045; G09G 2320/0666; G09G 2320/103; G09G 2340/0457; G09G 3/2044; G09G 3/2074; G09G 3/2085; G09G 3/2096; G09G 3/30; G09G 5/02; G09G 5/026; G09G 5/30; G09G 2300/00; G09G 2300/04; G09G 2300/0439; G09G 2300/0452; G09G 2300/0804; G09G 2300/0819; G09G 2310/0205; G09G 2310/0216; G09G 2310/0232; G09G 2320/04
See application file for complete search history.

(56) References Cited

U.S. PATENT DOCUMENTS

| | | | | |
|---|---|---|---|---|
| 9,013,381 | B2 * | 4/2015 | Kim | G09G 3/3233 345/83 |
| 2015/0009194 | A1 * | 1/2015 | Kim | G09G 3/3233 345/211 |
| 2015/0009242 | A1 * | 1/2015 | Park | G09G 3/3233 345/690 |
| 2015/0015590 | A1 * | 1/2015 | Jeong | G09G 3/2003 345/502 |
| 2015/0248855 | A1 * | 9/2015 | Kim | G09G 3/2074 345/590 |
| 2016/0129218 | A1 * | 5/2016 | Mok | A61M 21/02 345/694 |
| 2017/0193880 | A1 * | 7/2017 | Lee | G09G 3/2003 |

* cited by examiner

VERTICAL STRIPE

OUTPUT CHARACTERISTIC OF M2 DRIVE TFT

SUBPIXEL ARRANGEMENT IN A CASE OF LUMINANCE: G>R>B1>B2

SUBPIXEL ARRANGEMENT IN A CASE OF LUMINANCE: G>B1>R>B2

SUBPIXEL ARRANGEMENT IN A CASE OF LUMINANCE: B1>R>G>B2

FIG. 13A

| CONDITION | | | | |
|---|---|---|---|---|
| | R | G | B1 | B2 |
| APERTURE RATIO | 8% | 8% | 8% | 8% |
| CIEx | 0. 674 | 0. 195 | 0. 114 | 0. 14 |
| CIEy | 0. 324 | 0. 755 | 0. 148 | 0. 061 |
| LE(cd/A) | 48. 1 | 94. 8 | 22. 5 | 6. 3 |

FIG. 13B

| SIMULATION RESULT | B1(LIGHT)+B2(DEEP) IS 6500K AT CIEy=0.125 | | | |
|---|---|---|---|---|
| W | | | | |
| LUMINANCE(nit) | 450 | | | |
| COLOR TEMPERATURE(K) | 6505 | duv | 0. 0002 | |
| | | | | |
| | R | G | B1 | B2 |
| LUMINANCE(cd/m2) | 1798 | 2827 | 870. 797 | 134 |
| LUMINANCE RATIO | 2. 06 | 3. 25 | 1. 00 | 0. 15 |
| mA/cm2 | 3. 74 | 2. 98 | 3. 87 | 2. 13 |

FIG. 15A

| CONDITION | | | | |
|---|---|---|---|---|
| | R | G | B1 | B2 |
| APERTURE RATIO | 8% | 8% | 8% | 8% |
| CIEx | 0. 674 | 0. 195 | 0. 130 | 0. 14 |
| CIEy | 0. 324 | 0. 755 | 0. 300 | 0. 061 |
| LE(cd/A) | 48. 1 | 94. 8 | 30 | 6. 3 |

FIG. 15B

| SIMULATION RESULT | B1(LIGHT)+B2(DEEP) IS 6500K AT CIEy=0.2 | | | |
|---|---|---|---|---|
| W | | | | |
| LUMINANCE(nit) | 450 | | | |
| COLOR TEMPERATURE(K) | 6511 | duv | 0. 0003 | |
| | | | | |
| | R | G | B1 | B2 |
| LUMINANCE(cd/m2) | 1770 | 2011 | 1606 | 236 |
| LUMINANCE RATIO | 1. 10 | 1. 25 | 1. 00 | 0. 15 |
| mA/cm2 | 3. 68 | 2. 12 | 5. 35 | 3. 75 |

FIG. 17A

| CONDITION | | | | |
|---|---|---|---|---|
| | R | G | B1 | B2 |
| APERTURE RATIO | 8% | 8% | 8% | 8% |
| CIEx | 0. 674 | 0. 195 | 0. 180 | 0. 14 |
| CIEy | 0. 324 | 0. 755 | 0. 420 | 0. 061 |
| LE(cd/A) | 48. 1 | 94. 8 | 50 | 6. 3 |

FIG. 17B

| SIMULATION RESULT B1(LIGHT)+B2(DEEP) IS 9200K AT CIEy=0.2 | | | | |
|---|---|---|---|---|
| W | | | | |
| LUMINANCE(nit) | 450 | | | |
| COLOR TEMPERATURE(K) | 9215 | duv | 0. 0000 | |
| | | | | |
| | R | G | B1 | B2 |
| LUMINANCE(cd/m2) | 1511 | 1645 | 2004 | 461 |
| LUMINANCE RATIO | 0. 75 | 0. 82 | 1. 00 | 0. 23 |
| mA/cm2 | 3. 14 | 1. 74 | 4. 01 | 7. 32 |

ERROR DIFFUSION TYPE A
(PARTICULARLY ADDRESSING COLOR EDGE PREVENTION)

ERROR DIFFUSION TYPE B
(PARTICULARLY ADDRESSING SHARPNESS)

ERROR DIFFUSION TYPE A
(PARTICULARLY ADDRESSING COLOR EDGE PREVENTION)

ERROR DIFFUSION TYPE B
(PARTICULARLY ADDRESSING SHARPNESS)

GLASS-TYPE ELECTRONIC APPARATUS

ORGANIC EL DISPLAY DEVICE

ELECTRO OPTICAL DEVICE, ELECTRIC APPARATUS AND PIXEL RENDERING METHOD

CROSS-REFERENCE TO RELATED APPLICATIONS

This Non-provisional application claims priority under 35 U.S.C. § 119(a) on Patent Application No. 2015-031466 filed in Japan on Feb. 20, 2015, the entire contents of which are hereby incorporated by reference.

FIELD

The disclosure relates to an electro optical device, an electric apparatus and a pixel rendering method. More specifically, the disclosure relates to an electro optical device including a pixel array in which pixels constituted by subpixels of four or more colors are arranged, an electric apparatus utilizing the electro optical device as a display device, and a pixel rendering method.

BACKGROUND

Since an organic Electro Luminescence (EL) element is a self-light-emitting element of a current driven type, the need for a backlight is eliminated while the advantage of low-power consumption, high viewing angle, high contrast ratio or the like is obtained; it is expected to perform well in the development of a flat panel display.

In an organic EL display device using such an organic EL element, subpixels of different colors of red (R), green (G) and blue (B) are used to constitute a large number of pixels, which makes it possible to display various kinds of color images. While these subpixels of R, G, and B (RGB) may be located in various different forms, they are generally arranged in stripes by equally placing subpixels of different colors (so-called RGB vertical stripe arrangement), as illustrated in FIG. 1. All colors can be displayed by adjusting the brightness among the three subpixels. In general, adjacent three subpixels of R, G and B are collectively regarded as one rectangular pixel, and such rectangular pixels are arranged in a square to realize a dot matrix display. In the display device of a dot matrix type, image data to be displayed has a matrix arrangement of n×m. A correct image can be displayed by associating the image data with each pixel one for one.

Furthermore, organic EL display devices have different structures including a color filter type which creates the three colors of RGB with a color filter on the basis of a white organic EL element, and a side-by-side selective deposition type which deposits different colors on the respective organic EL materials for the three colors of RGB using Fine Metal Mask (FMM). While the color filter type has a disadvantage in that the light use efficiency is lowered as the color filter absorbs light, resulting in higher power consumption, the side-by-side selective deposition type can easily have wider color gamut due to its high color purity and can have higher light use efficiency because a color filter is eliminated, thereby being widely used.

Here, it is important for a display device such as an organic EL display device or a liquid crystal display (LCD) device to have enhanced resolution, and thus various methods of devising the arrangement of subpixels have been proposed to improve native resolution. For example, as to a liquid crystal display device, a method has been proposed for improving native resolution by utilizing the characteristic of human eye which senses G or Y (Yellow) brighter than R or B and constituting one pixel with four subpixels including Y in addition to RGB, so as to have two peak values of luminance in one pixel. Another method has also been proposed in which one pixel is constituted by subpixels of four colors including W (White) in addition to RGB. Furthermore, a rendering method with the configuration of subpixels of four colors such as RGBY or RGBW has also been disclosed. Moreover, as to an organic EL display device, for example, Woo-Young So et al., SID 10 DIGEST 43.3 (2010) (hereinafter referred to as Document 1) discloses a method of constituting one pixel with subpixels of four colors including R, G, B1 (light blue) and B2 (deep blue) as illustrated in FIG. 2.

SUMMARY

In an organic EL display device, since organic EL materials have different lifetime (aging speed) for colors of RGB and the organic EL material for B has the shortest lifetime in general, the colors lose balance over time, which shortens the lifetime of the organic EL display device. It is therefore necessary for an organic EL display device to alleviate the burden on the subpixel of B in order to extend the lifetime. However, no such an assumption is made in the rendering method used in the conventional liquid crystal display device that subpixels of different colors have different lengths of lifetime, if this rendering method is applied to an organic EL display device as it is, the subpixels of B1 and B2 will have increased burden, which cannot ensure a long lifetime of the organic EL display device.

Furthermore, in Document 1, a region which may be expressed by RGB1 (light blue) is defined as Region 1 while the region other than that is defined as Region 2. B2 (deep blue) is used only in Region 2 so as to ensure a long lifetime of the organic EL display device. In this method, however, a light emitting region is constantly biased due to extreme limitations in the use of B2 (deep blue), causing significant problems in display quality such as a worsened color mixture property as well as an occurrence of color edge even in a normal white display.

According to an aspect of the present invention, an electro optical device includes a pixel array constituted by pixels arranged in matrix, each pixel including four subpixels, the four subpixels including subpixels of colors of R (Red), G (Green) and B (Blue), and a subpixel of a similar color to a specific color, the specific color being a color of subpixel including a light emitting material having a shortest lifetime among the light emitting materials included in the subpixels of colors of R, G and B, respectively, and the four subpixels being arranged in two rows and two columns. The electro optical device includes a control unit that executes switching between a first driving condition and a second driving condition, as conditions for driving the pixels, in accordance with a color of a pixel to be displayed. The first driving condition is a condition in which both the subpixel of the specific color and the subpixel of the similar color are driven to emit light with a first luminance ratio, and the second driving condition is a condition in which both the subpixel of the specific color and the subpixel of the similar color are driven to emit light with a second luminance ratio different from the first luminance ratio. Furthermore, each of the pixels includes: a first subpixel having a highest emission luminance and a second subpixel having a second highest emission luminance among subpixels needed to display a white color, both the first subpixel and the second subpixel being arranged on one diagonal line of the pixel; and a third subpixel having a third highest emission luminance and a fourth subpixel having a lowest emission luminance, both the third subpixel and the fourth subpixel being arranged on another diagonal line of the pixel.

According to an aspect of the present invention, an electric apparatus includes, as a display device, an organic electro luminescence device in which the pixel array including a subpixel containing an organic electro luminescence material and a circuit unit driving the pixel array are formed on a substrate.

An aspect of the present invention is a pixel rendering method in an electro optical device including a pixel array constituted by pixels arranged in matrix, each pixel including four subpixels, the four subpixels including subpixels of colors of R (Red), G (Green) and B (Blue), and a subpixel of a similar color to a specific color, the specific color being a color of subpixel including a light emitting material having a shortest lifetime among the light emitting materials included in the subpixels of colors of R, G and B, respectively, the four subpixels being arranged in two rows and two columns, and each of the pixels including: a first subpixel having a highest emission luminance and a second subpixel having a second highest emission luminance among subpixels needed to display a white color, both the first subpixel and the second subpixel being arranged on one diagonal line of the pixel; and a third subpixel having a third highest emission luminance and a fourth subpixel having a lowest emission luminance, both the third subpixel and the fourth subpixel being arranged on another diagonal line of the pixel. The pixel rendering method comprises: extracting a singularity which is to be an end of an image to be displayed in the pixel array; and making a subpixel emit light with a predetermined value of luminance, the subpixel being in an adjacent pixel located adjacent to the subpixel having the highest emission luminance or the subpixel having the lowest emission luminance among pixels arranged at the singularity.

It is to be understood that both the foregoing general description and the following detailed description are exemplary and explanatory and are not restrictive of the invention.

BRIEF DESCRIPTION OF THE DRAWINGS

FIG. 13 A and FIG. 13 B are tables illustrating an example of a simulation in which data (R, G, B1 and B2 data) for driving a pixel is calculated according to an embodiment;

FIG. 15 A and FIG. 15 B are tables illustrating another example of a simulation in which data (R, G, B1 and B2 data) for driving a pixel is calculated according to an embodiment;

FIG. 17 A and FIG. 17 B are tables illustrating another example of a simulation in which data (R, G, B1 and B2 data) for driving a pixel is calculated according to an embodiment;

DETAILED DESCRIPTION

Figure 1:
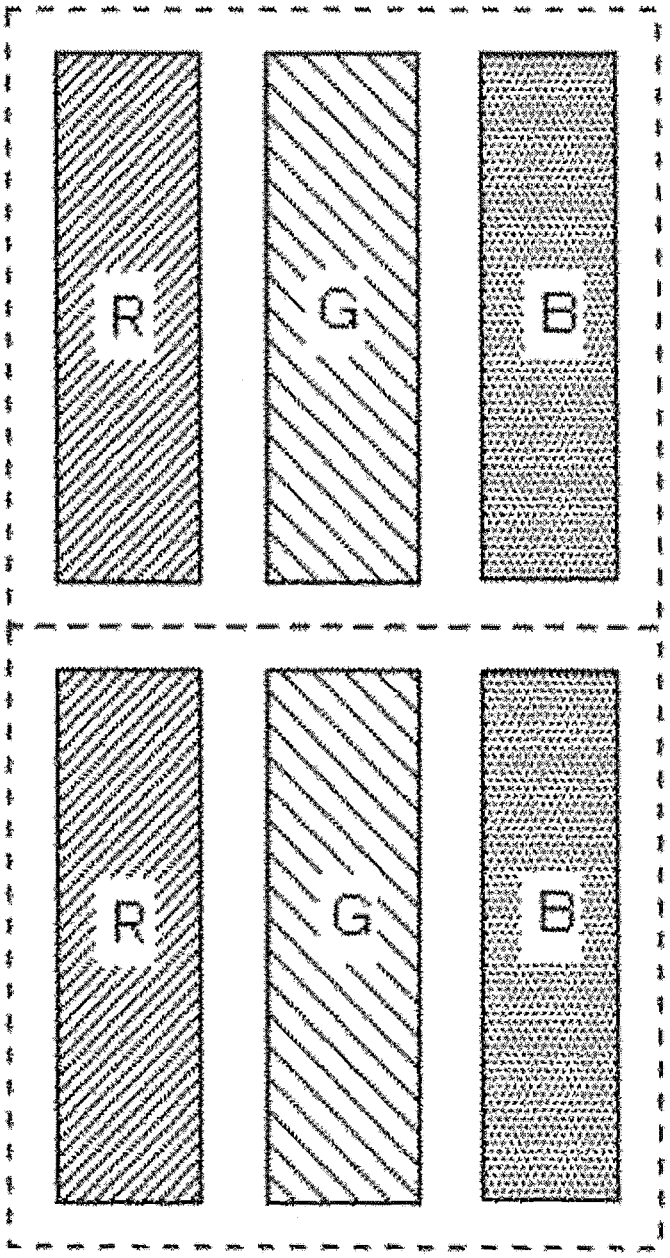
FIG. 1 RELATED ART
FIG. 1 is a plan view schematically illustrating a subpixel arrangement (vertical stripes) of a conventional organic EL display device.
Figure 2:
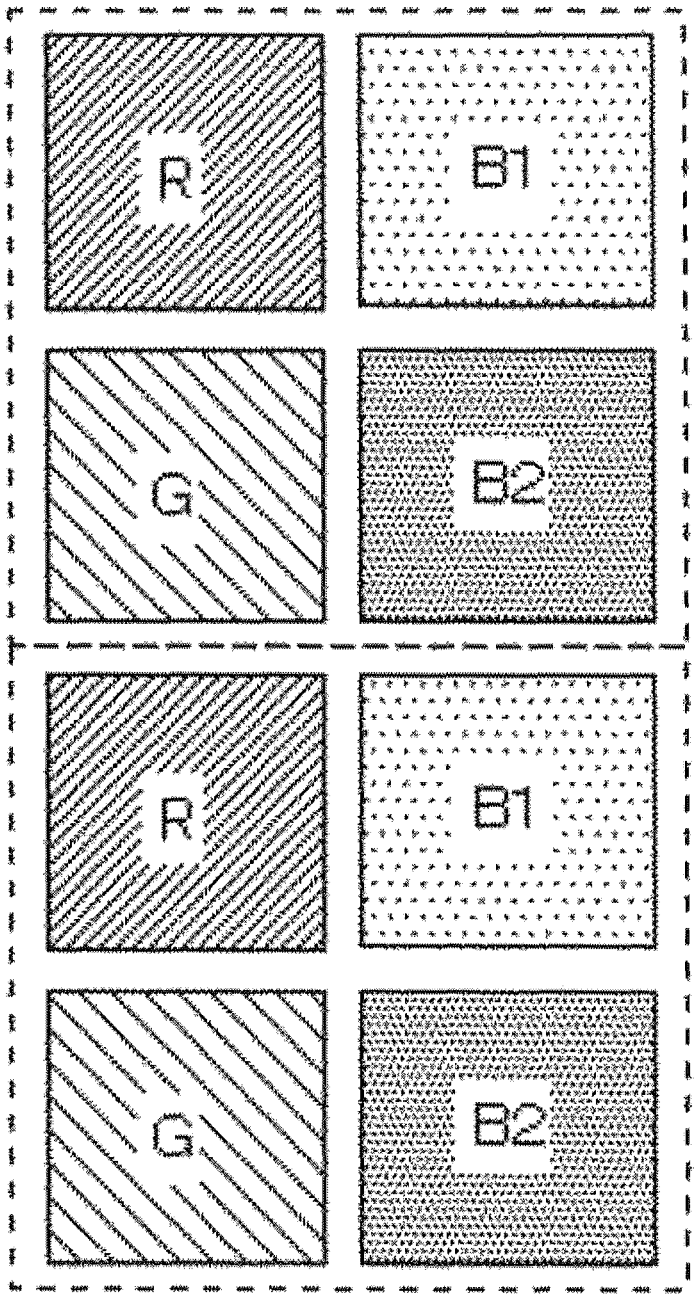
FIG. 2 RELATED ART
FIG. 2 is a plan view schematically illustrating a subpixel arrangement (RGB1B2) of a conventional (Document 1) organic EL display device.

As described in the background section, it is important for a display device such as an organic EL display device or a liquid crystal display device to have enhanced resolution, and various methods of devising the arrangement of subpixels have been proposed to improve native resolution. For example, as to a liquid crystal display device, a method of constituting one pixel with subpixels of four colors of RGBY or constituting one pixel with subpixels of four colors of RGBW has been proposed. Moreover, as to an organic EL display device, as described in Document 1, a method of constituting one pixel with subpixels of four colors of R, G, B1 (light blue) and B2 (deep blue) has been disclosed.

Here, since an organic EL display device may easily be applied to a wider color gamut due to its high color purity and thus the light use efficiency thereof is enhanced, the side-by-side selective deposition type is widely used in which organic EL materials are individually deposited. Organic EL materials for RGB colors, however, have different periods of lifetime (aging speed), the organic EL material for the color B having the shortest lifetime. More specifically, the luminescent color of B has a larger band gap compared to the other luminescent colors, the molecular structure thereof having a small conjugate system, making a molecule itself vulnerable. In particular, a phosphorescent material has high excited triplet energy, which makes it susceptible to a minute amount of quencher present in the system. Moreover, the host material for holding a luminescence material requires even higher excited triplet energy. As the lifetime of the organic EL material for B is short, the colors lose balance over time, resulting in a shorter lifetime of a display device.

Accordingly, as the organic EL material for B generally has the shortest lifetime in an organic EL display device and the colors lose balance over time, it is necessary to alleviate the burden on the subpixel of B. However, because no such an assumption is made in the rendering method used in the conventional liquid crystal display device that subpixels of different colors have different lengths of lifetime, if the rendering method is applied to an organic EL display device as it is, the subpixels of B1 and B2 will have increased burden, which cannot ensure a long lifetime of the organic EL display device. Furthermore, according to the method of using B2 only in the case where the color of Region 2 which cannot be expressed with RGB1 is displayed as described in Document 1, a light emitting region is constantly biased, causing significant problems in display quality such as a worsened color mixture property as well as an occurrence of color edge even in a normal white display.

To address this problem, the present inventors have obtained the luminance of a subpixel of each color in the case where W is displayed with the subpixels of four colors of R, G, B1 and B2 by simulation, to find that the subpixels needed to display W does not have constant proportion in the luminance but may be combined in different ways.

Thus, an embodiment does not have a configuration in which the region on the chromaticity diagram is simply divided into a region using B2 and a region not using B2, and B2 are used only for a color in the region using B2, as described in Document 1. According to an embodiment, B2 emits light with current of a predetermined value or lower over the entire color gamut while the luminance for B mainly relies on the light emission of B1, so that a long lifetime of an organic EL display device is ensured while the color mixture property is enhanced. Moreover, as to the arrangement of subpixels, a subpixel having the highest emission luminance (highest priority pixel) and a subpixel having the second highest emission luminance (second highest priority pixel) among the subpixels needed to display a white color are arranged on a diagonal line to control the balance in luminance not only in the vertical direction but also in the lateral direction for performing error diffusion, which restrains the center of the luminance from being displaced and suppresses the occurrence of color edge.

According to the present embodiment, in the pixel array in which subpixels of four or more colors including multiple colors (light blue and deep blue, for example) divided from a color including an organic EL material having a short lifetime (blue, for example) are arranged, the subpixel with the highest luminance and the subpixel with the second highest luminance are arranged on a diagonal line of the pixel, to suppress degrading of the color mixture property or the occurrence of color edge and thus to enhance native resolution. Moreover, since the subpixel of a color including the material having the shortest lifetime is also driven with current of a certain value or lower in accordance with the luminance ratio determined depending on the region on the chromaticity diagram to which a color to be displayed belongs, the degrading of color mixture property or the occurrence of color edge may be suppressed while ensuring a long lifetime of a device, and therefore native resolution may be enhanced.

The embodiment of the present invention will be described below with reference to the drawings. It is to be noted that an electro optical element means a general electron element which changes the optical state of light by an electric action, and includes, in addition to a self-light-emitting element such as an organic EL element, an electron element such as a liquid-crystal element which changes the polarization state of light to implement gradation display. Furthermore, an electro optical device means a display device utilizing an electro optical element for display. Since an organic EL element is suitable and the use of an organic EL element can obtain a current-driven light emitting element which allows self-light emission when driven with current, an organic EL element is given as an example in the description below.

Figure 3:
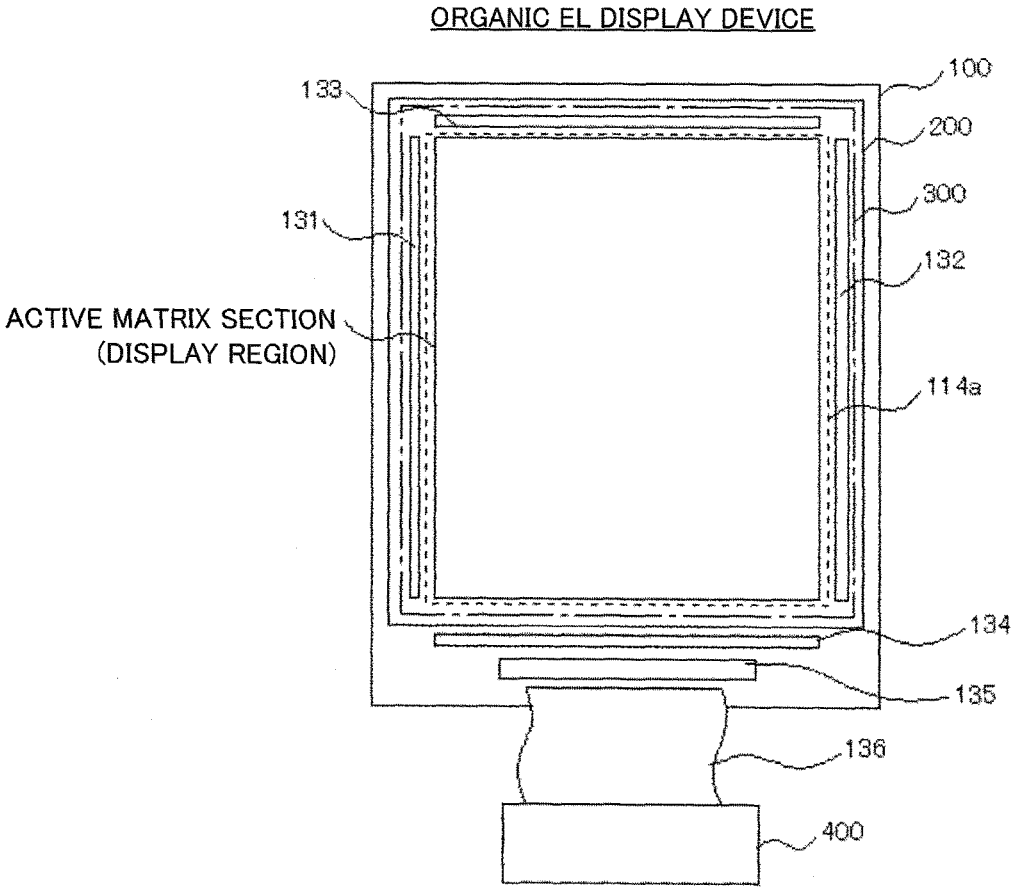
FIG. 3 is a plan view of an organic EL display device according to an embodiment.

FIG. 3 illustrates an organic EL display device as an example of an electro optical device. The organic EL display device includes, as main components, a thin film transistor (TFT) substrate 100 on which a light emitting element is formed, a sealing glass substrate 200 which seals the light emitting element, and a bonding means (glass frit seal part) 300 which bonds the TFT substrate 100 to the sealing glass substrate 200. Moreover, around a cathode electrode forming region 114*a* outside the display region of the TFT substrate 100 (active matrix section), for example, a scanning driver 131 (TFT circuit) which drives a scanning line on the TFT substrate 100, an emission control driver 132 (TFT circuit) which controls the light emission period of each pixel, a data line electro static discharge (ESD) protection circuit 133 which prevents damage caused by electrostatic discharge, a demultiplexer (1:n DeMUX 134, analog switch TFT) which returns a stream at a high transfer rate to multiple streams at a former low transfer rate, a data driver IC 135 which is mounted using an anisotropic conductive film (ACF) and which drives a data line, are located. The organic EL display device is connected with an external device (for example, a control device 400 for controlling the entire operation, particularly rendering, of the organic EL display device) through a flexible printed circuit (FPC) 136. Since FIG. 3 is a mere example of an organic EL display device according to the present embodiment, the shape and configuration thereof may appropriately be modified. For example, all the functions of controlling the rendering may be included in the driver IC 135.

Figure 4:
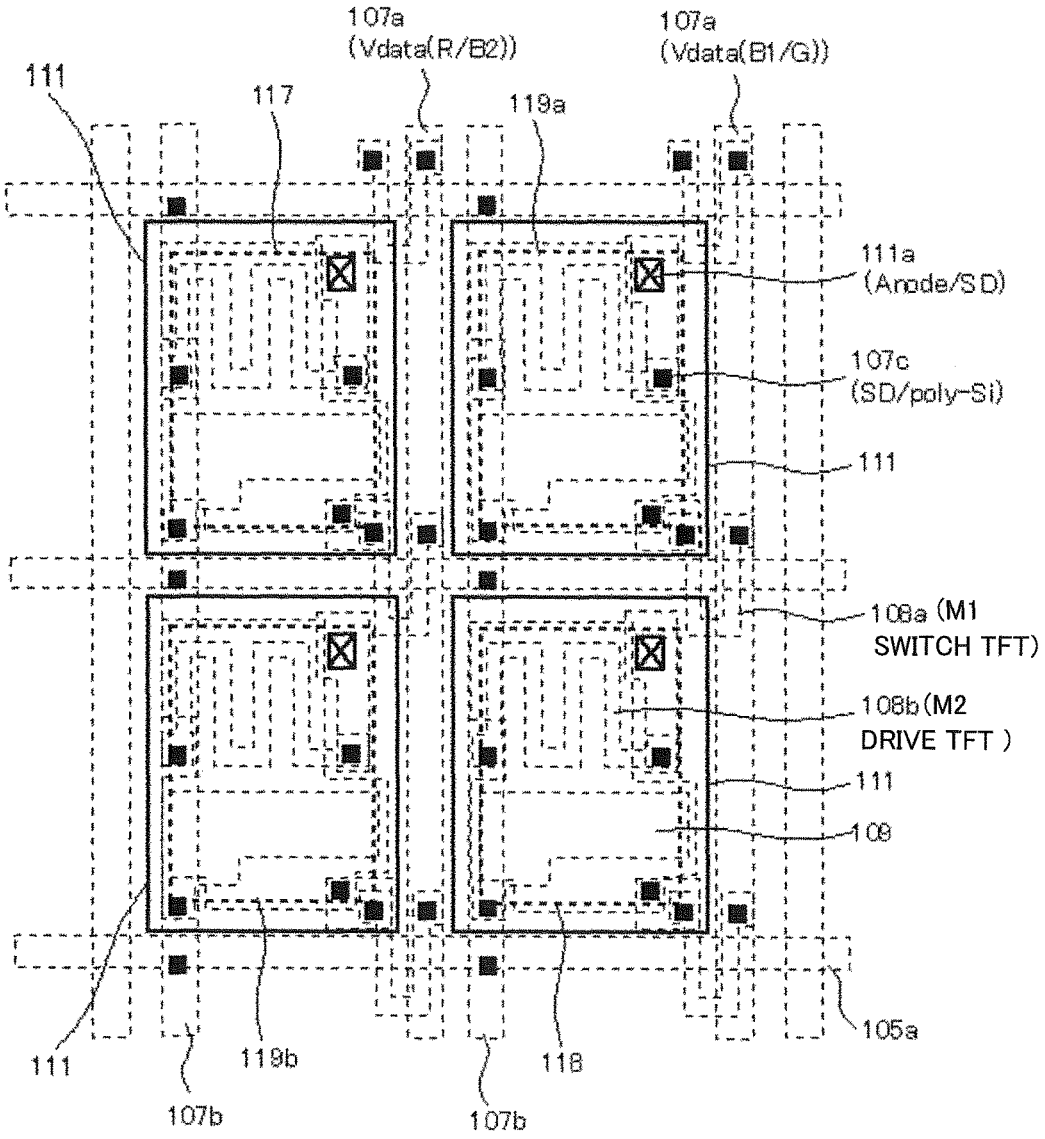
FIG. 4 is a plan view schematically illustrating the configuration of a set of pixel (corresponding to four subpixels) in an organic EL display device according to an embodiment.
Figure 5:
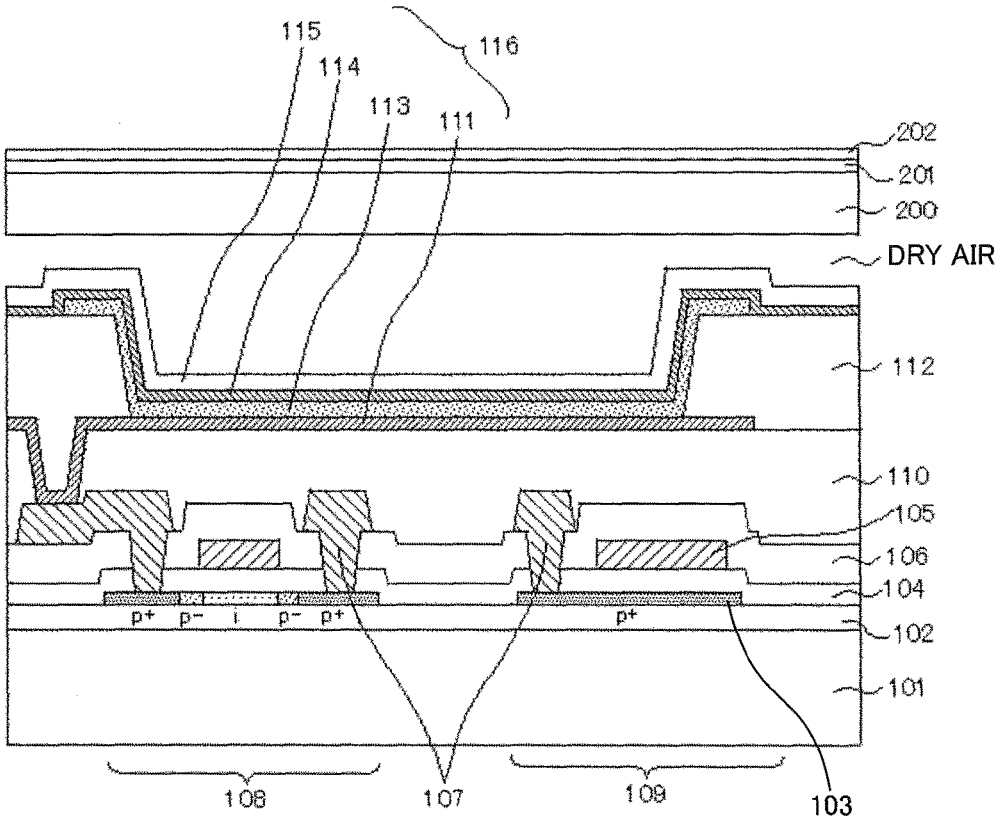
FIG. 5 is a section view schematically illustrating the configuration of a pixel (corresponding to one subpixel) in an organic EL display device according to an embodiment.

FIG. 4 is a plan view specifically illustrating a set of pixel (a pixel composed of R/B1 subpixels at upper side and B2/G subpixels at lower side) in a light emitting element formed on the TFT substrate 100, and the set of pixel is repeatedly formed in the extending direction of data line and the extending direction of scanning line (gate electrode) (vertical and lateral directions in the drawing). FIG. 5 is a section view specifically illustrating one subpixel. In FIG. 5, for clarifying the structure of a subpixel according to the present embodiment, the regions of a TFT part 108*b* (M2 drive TFT) and a retention capacitance part 109 in the plan view of FIG. 4 are taken out and simplified for their illustration. While, in the description below, an example is shown where two types of subpixels including B1 of light blue and B2 of deep blue are provided for the color B, R needs to have the luminance approximately three times the luminance for B, and the organic EL material for R may be degraded faster when compared with the luminance of one third. In that case, two types of subpixels including R1 which is yellowish red and R2 which is normal red may be provided for the color R. That is, the present embodiment is to prepare subpixels of two or more types of similar colors for a color with an organic EL material having a short lifetime, the colors being appropriately changeable depending on the characteristic of the organic EL material. Moreover, it is not always necessary to employ similar colors for a color with a short lifetime, but is also possible to ensure the luminance with e.g. green yellow and to widen the color gamut with emerald green close to blue while alleviating the burden on blue in white display so as to ensure a long lifetime.

The TFT substrate 100 is constituted by: a poly silicon layer 103 made of low-temperature poly silicon (LTPS) or the like formed on a glass substrate 101 through an underlying insulation film 102; a first metal layer 105 (a gate electrode 105*a* and a retention capacitance electrode 105*b*) formed through a gate insulation film 104; a second metal layer 107 (a data line 107*a*, a power supply line 107*b*, a source/drain electrode, a first contact part 107*c*) connected to the poly silicon layer 103 through an aperture formed at an interlayer insulation film 106; and a light emitting element 116 (an anode electrode 111, an organic EL layer 113, a cathode electrode 114 and a cap layer 115) formed through a planarization film 110.

Dry air is enclosed between the light emitting element 116 and the sealing glass substrate 200, which is then sealed by the glass frit seal part 300, to form an organic EL display device. The light emitting element 116 has a top emission structure, in which the light emitting element 116 and the sealing glass substrate 200 are set to have a predetermined space between them while a $\lambda/4$ retardation plate 201 and a polarization plate 202 are formed on the side of the light emitting surface of the sealing glass substrate 200, so as to suppress reflection of light entering from the outside.

In FIG. 4, each of the subpixels of R, G, B1 and B2 is formed in a region interposed between the data line 107*a* and the power supply line 107*b* in the vertical direction and interposed between the gate electrodes 105*a* in the horizontal direction, while the switch TFT 108*a*, drive TFT 108*b* and retention capacitance part 109 are arranged inside or near each region of the subpixels. Here, in the case of the pixel arrangement structure of the RGB vertical stripe arrangement, the data line 107*a* corresponding to subpixels of each color is repeatedly arranged in the horizontal direction, while subpixels constituting one pixel are arranged in the horizontal and vertical directions in the subpixel arrangement according to the present example. Accordingly, each data line 107*a* is shared by two subpixels (here, a data line for R/B2 subpixels (indicated as Vdata(R/B2)) and a data line for B1/G subpixels (indicated as Vdata(B1/G))), and is repeatedly arranged in the horizontal direction.

More specifically, the subpixel of B1 (subpixel on the upper right in FIG. 4) in B which has the lowest luminosity factor is driven by using the TFT part 108*a* (M1 switch TFT) and the TFT part 108*b* (M2 drive TFT) connected to the gate electrode 105*a* in the middle of the drawing, data line 107*a* for B1/G and the power supply line 107*b* in the middle of the drawing. Moreover, the subpixel of B2 (subpixel at the lower left in FIG. 4) in B which has the lowest luminosity factor is driven by using the TFT part 108*a* (M1 switch TFT) and the TFT part 108*b* (M2 drive TFT) connected to the gate electrode 105*a* at the lower side of the drawing, the data line 107*a* for R/B2 and the power supply line 107*b* at the left side of the drawing. Furthermore, the subpixel of R (subpixel at the upper left in FIG. 4) is driven by using the TFT part 108*a* (M1 switch TFT) and the TFT part 108*b* (M2 drive TFT) connected to the gate electrode 105*a* in the middle of the drawing, the data line 107*a* for R/B2 and the power supply line 107*b* at the left side of the drawing. In addition, the subpixel for G which has the highest luminosity factor (subpixel at the lower right in FIG. 4) is driven by using the TFT part 108*a* (M1 switch TFT) and the TFT part 108*b* (M2 drive TFT) connected to the gate electrode 105*a* at the lower side of the drawing, the data line 107*a* for B1/G and the power supply line 107*b* in the middle of the drawing.

Furthermore, the anode electrode 111 and the light emitting region for each color of R, G, B1 and B2 is formed to have a size that may secure a distance to the anode electrode 111 and the light emitting region of another color. Moreover, each light emitting region may be processed by, for example, scraping four corners as necessary in order to facilitate the manufacturing of the FMM while securing the distance between apertures in the FMM.

It is to be noted that the color having the highest luminosity factor and the color having the lowest luminosity factor as described in the present specification and claims have relative meanings, indicating "highest" and "lowest" in a comparison among multiple subpixels included in one pixel. Moreover, though light blue is indicated as B1 whereas deep blue is indicated as B2 in the present embodiment, B1 may be any color as long as it has a color gamut closer to white (that is, a smaller band gap and a longer lifetime) compared to B2. Furthermore, the switch TFT 108*a* is formed to have a dual gate structure as illustrated so as to suppress crosstalk from the data line 107*a*, and the drive TFT 108*b* which converts voltage into current is formed to have a routed shape as illustrated in order to minimize the variation in the manufacturing process, thereby ensuring a sufficient channel length. Furthermore, the gate electrode of the drive TFT is extended to be used as an electrode of the retention capacitance part 109 so as to ensure sufficient retention capacitance with a limited area. Such a pixel structure allows the colors of RGB to have larger light-emitting regions, making it possible to lower the current density per unit area of each color for obtaining necessary luminance, and to extend the lifetime of a light emitting element.

While FIG. 5 illustrates a top emission structure in which light radiated from the light emitting element 116 is directed to the outside through the sealing glass substrate 200, a bottom emission structure may also be possible in which the light is radiated to the outside through the glass substrate 101.

Figure 6:
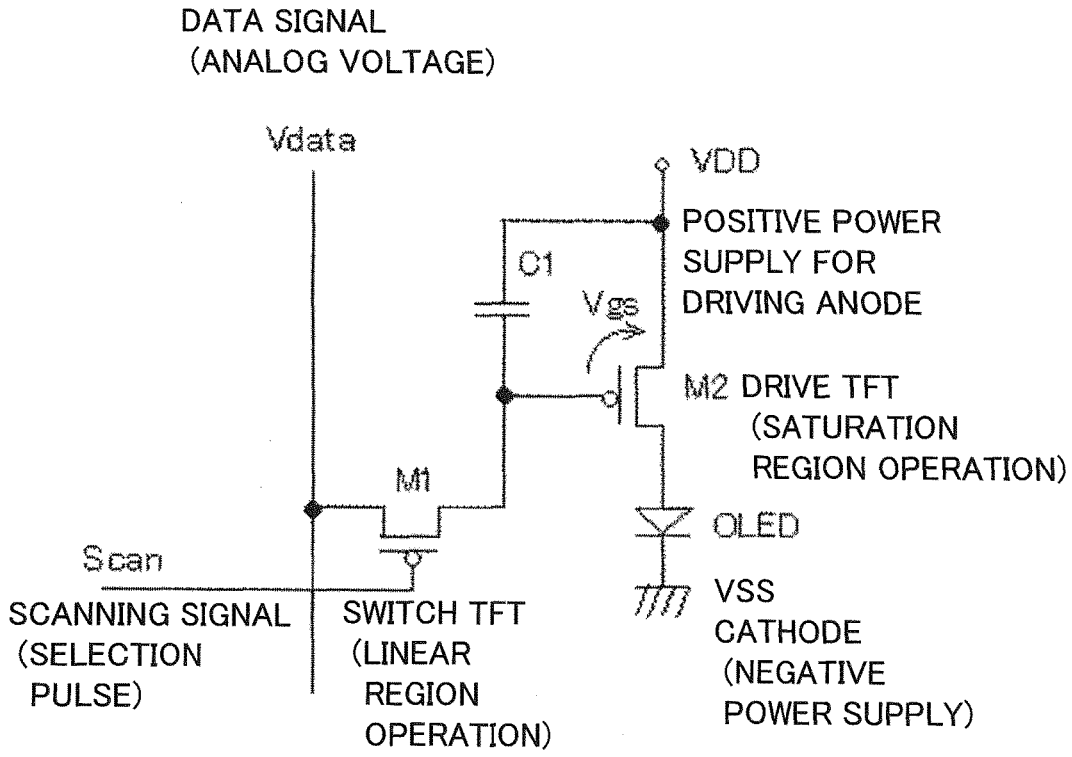
FIG. 6 is a main circuit configuration diagram of a pixel in an organic EL display device according to an embodiment.
Figure 7:
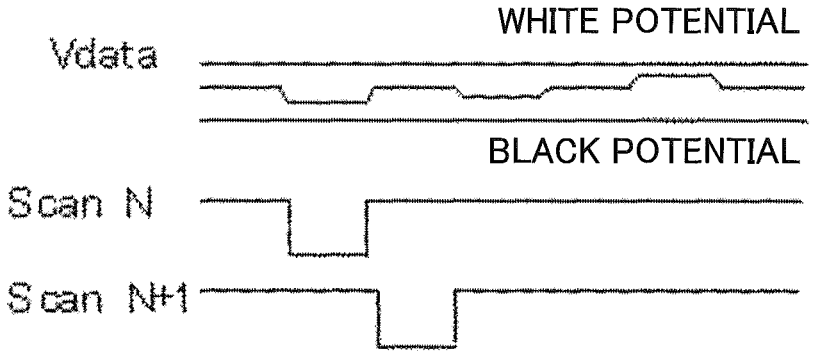
FIG. 7 is a waveform of a pixel in an organic EL display device according to an embodiment.
Figure 8:
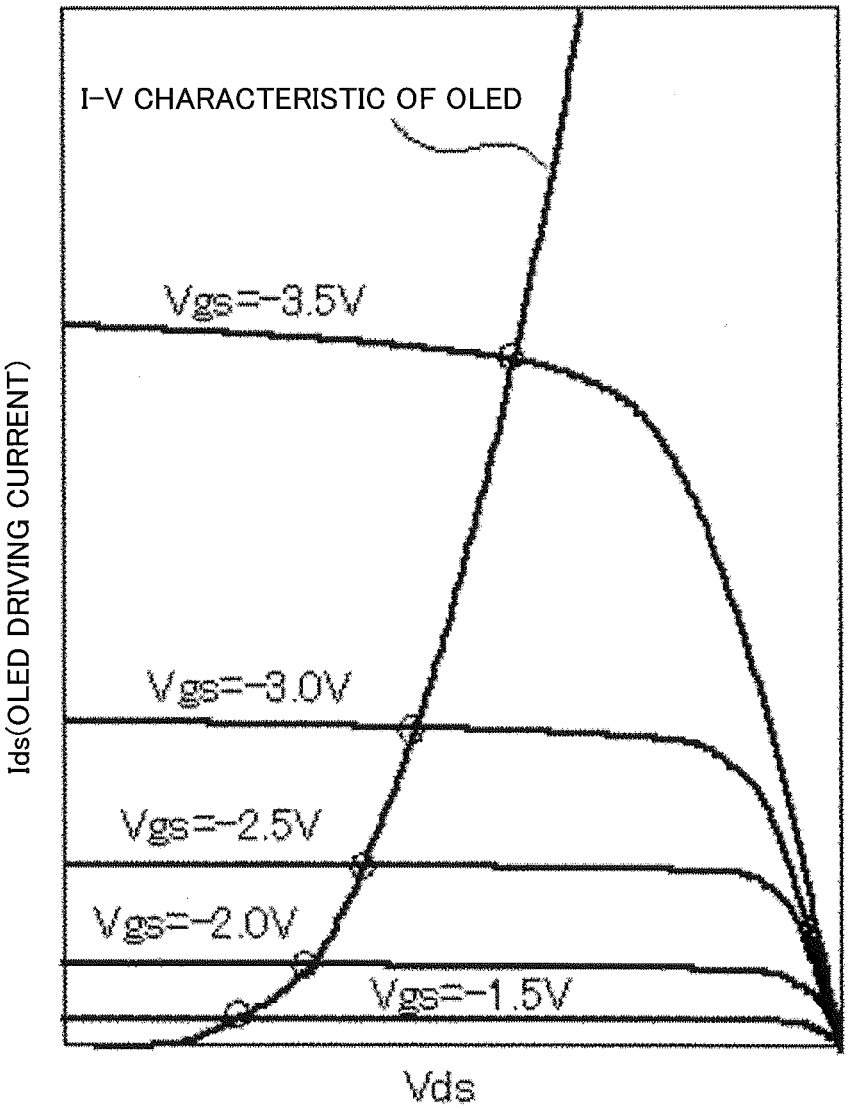
FIG. 8 is an output characteristic view of a drive TFT in an organic EL display device according to an embodiment.

Next, a method of driving each subpixel will be described with reference to FIGS. 6 to 8. FIG. 6 is a main circuit configuration diagram of a subpixel, FIG. 7 is a waveform and FIG. 8 is an output characteristic view of a drive TFT. Each subpixel is configured by including the M1 switch TFT, M2 drive TFT, C1 retention capacitance and light emitting element (OLED), and is drive-controlled with a two-transistor system. The M1 switch TFT is a p-channel field effect transistor (FET), the gate terminal of which is connected to a scanning line (Scan) and the drain terminal of which is connected to a data line (Vdata). The M2 drive TFT is a p-channel FET, the gate terminal of which is connected to the source terminal of the M1 switch TFT. Moreover, the source terminal of the M2 drive TFT is connected to the power supply line (VDD), whereas the drain terminal thereof is connected to the light emitting element (OLED). Furthermore, a C1 retention capacitance is formed between the gate and the source of the M2 drive TFT.

In the configuration described above, when a selection pulse (scanning signal) is outputted to the scanning line (Scan) to make the M1 switch TFT in an open state, the data signal supplied through the data line (Vdata) is written into the C1 retention capacitance as a voltage value. The retention voltage written into the C1 retention capacitance is held over a period of one frame, the retention voltage causing the conductance of the M2 drive TFT to change in an analog manner, to supply forward bias current, corresponding to a gradation level of light emission, to the light emitting element (OLED).

As described above, since the light emitting element (OLED) is driven with constant current, the luminance of emitted light may be maintained to be constant despite a possible change in the resistance due to degrading of the light emitting element (OLED), which is thus suitable for a method of driving an organic EL display device according to the present embodiment.

Figure 9:
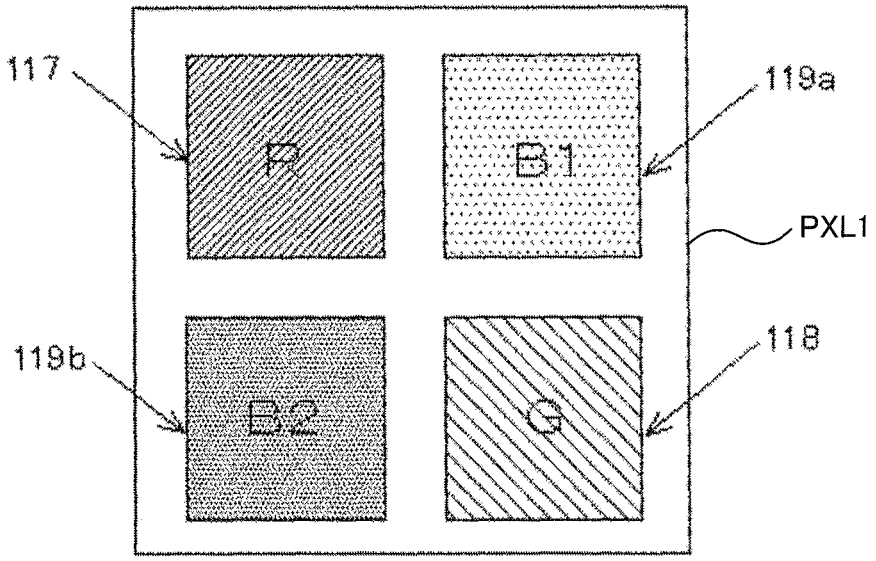
FIG. 9 is a schematic view illustrating an example of a subpixel arrangement according to an embodiment.
Figure 10:
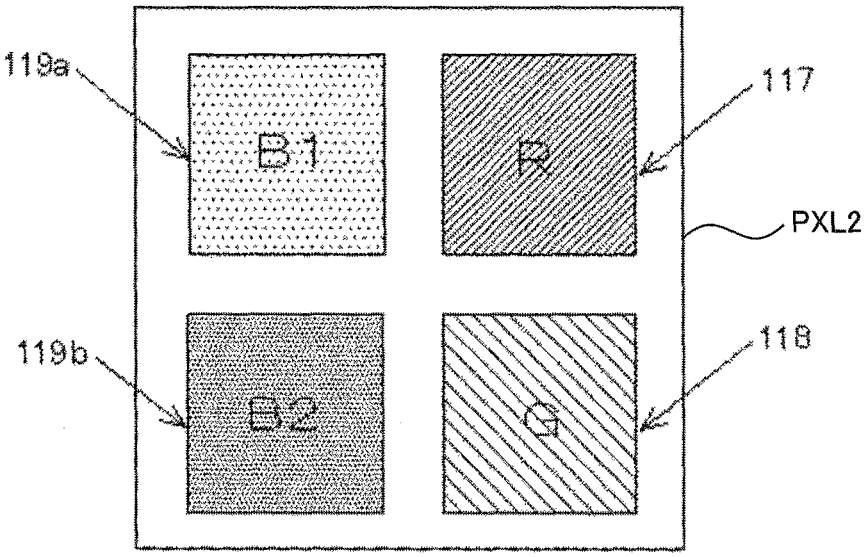
FIG. 10 is a schematic view illustrating another example of a subpixel arrangement according to an embodiment.
Figure 11:
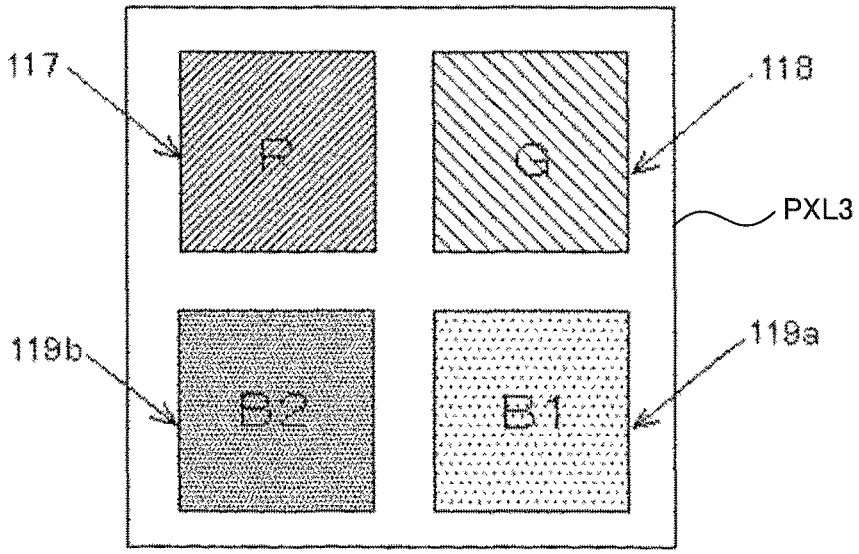
FIG. 11 is a schematic view illustrating another example of a subpixel arrangement according to an embodiment.

Next, the pixel arrangement structure of an organic EL display device with the structure described above will be described with reference to FIGS. 9 to 11. The subpixels of RGB1B2 illustrated in FIGS. 9 to 11 indicate the light-emitting regions serving as light emitting elements (the portion where the organic EL layer 113 is interposed between the anode electrode 111 and the cathode electrode 114 in FIG. 5). The light-emitting region indicates an aperture of the element separation film 112. In the case where the organic EL material is selectively deposited using an FMM, an FMM having an aperture slightly larger than the light-emitting region is set in alignment with the TFT substrate and the organic EL material is selectively deposited on the TFT substrate. Here, electric current actually flows only in portion of the aperture of the element separation film 112, which will thus be the light-emitting region. If the region of the aperture pattern of FMM overlaps with the region for another color (i.e. if the region where the organic EL material is deposited is widened), a defect called "color shift" occurs in which another luminescent color is mixed. Also, if the region comes inside its own aperture (that is, if the region where the organic EL material is deposited is narrowed), a fault risk of a vertical short-circuiting may be generated in which the cathode electrode 114 and the anode electrode 111 are short-circuited. Accordingly, the aperture pattern of FMM is so designed that an aperture boundary is formed at the outside of the light-emitting region for a target color and located substantially the midway to the light-emitting region for adjacent color. Though the alignment accuracy and the deformation amount of FMM is lower than the manufacturing accuracy in a photo process, the actual light-emitting region is decided by the light-emitting region opened by the photo process, so that any shape may accurately control the area. Moreover, in the case of repeatedly arranging the sets of subpixels, the boundary (solid line) for each pixel PXL1-PXL3 in FIGS. 9 to 11 is not defined by the components of the TFT substrate 100 but may be defined based on the relationship between adjacent sets of subpixels. The set of subpixel is defined to form a rectangle here though not necessarily limited to a rectangle.

The basic idea of the subpixel arrangement according to the present example is to arrange the subpixel with the highest light emission luminance (a first subpixel) and the subpixel with the second highest light emission luminance (a second subpixel) in the subpixel required for displaying a white color on a diagonal line in order to prevent the displacement of the luminance center and to improve the native resolution. According to the characteristic of organic EL material for each subpixel, for example, the subpixel arrangement as described below may be employed.

FIG. 9 illustrates the pixel PXL1 which includes R light-emitting region (subpixel of color of R) 117, G light-emitting region (subpixel of color of G) 118, B1 light-emitting region (subpixel of color of B1) 119*a* and B2 light-emitting region (subpixel of color of B2) 119*b*. For example, as illustrated in FIG. 9, in the case where the luminance for subpixels is higher in the order of G>R>B1>B2, the subpixel of G which has the highest luminance and the subpixel of R which has the second highest luminance are arranged on one diagonal line (here, the subpixel of G at the lower right and the subpixel of R at the upper left), while the remaining subpixels of B1 and B2 are arranged on the other diagonal line (here, the subpixel of B1 at the upper right and the subpixel of B2 at the lower left). In this subpixel arrangement, as long as the subpixel of G and the subpixel of R are arranged on a diagonal line, the arrangement of the subpixel of G and the subpixel of R may be inverted or the arrangement of the subpixel of B1 and the subpixel of B2 may be inverted.

FIG. 10 illustrates the pixel PXL2 which includes R light-emitting region (subpixel of color of R) 117, G light-emitting region (subpixel of color of G) 118, B1 light-emitting region (subpixel of color of B1) 119*a* and B2 light-emitting region (subpixel of color of B2) 119*b*. Moreover, as illustrated in FIG. 10, in the case where the subpixel of B1 has high luminance and the luminance for subpixels is higher in the order of G>B1>R>B2, the subpixel of G having the highest luminance and the subpixel of B1 having the second highest luminance are arranged on one diagonal line (here, the subpixel of G at the lower right and the subpixel of B1 at the upper left), while the remaining subpixels of R and B2 are arranged on the other diagonal line (here, the subpixel of R at the upper right and the subpixel of B2 at the lower left). Also in this subpixel arrangement, the arrangement of the subpixel of G and the subpixel of B1 may be inverted or the arrangement of the subpixel of R and the subpixel of B2 may be inverted. Moreover, though not illustrated, a similar subpixel arrangement may also be applied to the case where the luminance is higher in the order of B1>G>R>B2.

FIG. 11 illustrates the pixel PXL3 which includes R light-emitting region (subpixel of color of R) 117, G light-emitting region (subpixel of color of G) 118, B1 light-emitting region (subpixel of color of B1) 119*a* and B2 light-emitting region (subpixel of color of B2) 119*b*. Furthermore, as illustrated in FIG. 11, in the case where the subpixel of B1 has even higher luminance and the subpixel of G has low luminance and where the luminance for the subpixels is higher in the order of B1>R>G>B2, the subpixel of B1 having the highest luminance and the subpixel of R having the second highest luminance are arranged on one diagonal line (here, the subpixel of B1 at the lower right and the subpixel of R at the upper left), while the remaining subpixels of G and B2 are arranged on the other diagonal line (here, the subpixel of G at the upper right and the subpixel of B2 at the lower left). Also in this subpixel arrangement, the arrangement of the subpixel of B1 and the subpixel of R may be inverted or the arrangement of the subpixel of G and the subpixel of B2 may be inverted.

As mentioned above, the pixel includes a first subpixel having a highest emission luminance and a second subpixel having a second highest emission luminance among subpixels needed to display a white color, both the first subpixel and the second subpixel being arranged on one diagonal line of the pixel.

It is to be noted that the shape of each subpixel, the space between subpixels, the space between a subpixel and the periphery of the pixel are not limited to the illustrated configuration, but may appropriately be modified in consideration of the manufacturing accuracy and the display performance required for an organic EL display device.

As mentioned above, a pixel array is constituted by pixels arranged in matrix, each pixel including four subpixels. The four subpixels include subpixels of colors of R (Red), G (Green) and B (Blue), and a subpixel of a similar color to a specific color. The specific color is a color of subpixel including a light emitting material having a shortest lifetime among the light emitting materials included in the subpixels of colors of R, G and B, respectively.

Next, the procedure of generating data for driving RGB1B2 subpixels will be described with reference to the flowchart of FIG. 12. Since each pixel is constituted by four subpixels of four colors of R, G, B1 and B2 whereas input data corresponding to each pixel is configured with data for three colors of R, G and B, it is necessary to convert the input data for three colors into data for four colors. Furthermore, how much the subpixel of B2 is used is different depending on whether or not the color to be displayed can be represented by three colors of RGB1. Thus, according to the present embodiment, the first driving condition and the second driving condition are provided, and the driving conditions are switched at a control unit (control device 400 connected through the FPC 136 in FIG. 3) controlling the operation of the organic EL display device, so as to generate data of R, G, B1 and B2 such that the luminance ratio of the subpixels of four colors of R, G, B1 and B2 are the luminance ratio corresponding to the driving conditions.

Figure 12:
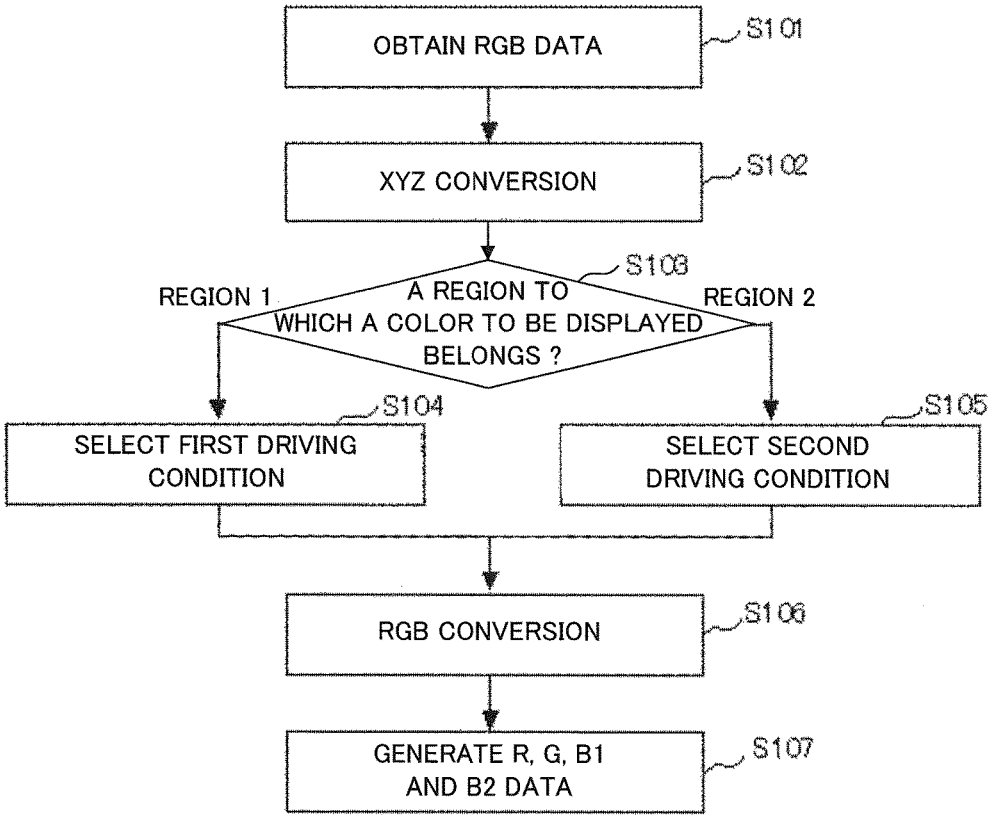
FIG. 12 is a flow chart illustrating a procedure of generating data (R, G, B1 and B2 data) for driving a pixel according to an embodiment.

More specifically, as illustrated in the flowchart of FIG. 12, if the RGB data corresponding to input data is obtained (S101), the control device coverts the RGB data into coordinates in the XYZ (Yxy) color coordinate system which is a CIE standard color coordinate system, using a known method (using a conversion matrix determined by the coordinates of R, G and B points and the coordinates of a white color point, for example) (S102). The chromaticity diagram of the XYZ color coordinate system expresses hues with locus of monochromatic lights and pure purples, and expresses color saturation at a position within a region enclosed by the locus. The RGB data is converted into coordinates in the XYZ color coordinate system to decide a position on the chromaticity diagram for a color to be displayed.

Next, the control device determines whether or not the position on the chromaticity diagram for a color to be displayed is within a region which can be expressed with RGB1 (region 1) or within a region which cannot be expressed with RGB1 (which can be expressed with RB1B2) (region 2) (S103). More specifically, the position of each color on the chromaticity diagram is specified based on the characteristic of organic EL material used as a subpixel, while the region enclosed by straight lines connecting the respective positions of R, G and B1 on the chromaticity diagram is set as the region 1 and the region enclosed by straight lines connecting the respective positions of R, B1 and B2 on the chromaticity diagram is set as the region 2. The control device then determines whether the position on the chromaticity diagram for a color to be displayed is within the region 1 or within the region 2.

While a color to be displayed can be represented by three colors of R, G and B1 in the case where the color to be displayed is within the region 1, a light emitting region is constantly biased in the control where B2 subpixels are not uniformly used (control disclosed in Document 1) in the case where the color to be displayed is within the region 1, resulting in poor color mixture as well as degrading in display quality due to the occurrence of a color edge even with a normal white display. In the present embodiment, therefore, even in the case where the color to be displayed is within the region 1, the first driving condition for lighting subpixels of four colors of R, G, B1 and B2 with the first luminance ratio is selected (S104). On the other hand, in the case where the color to be displayed is within the region 2, the second driving condition for lighting subpixels of four colors of R, G, B1 and B2 with the second luminance ratio having the luminance ratio of B2 higher than that in the first luminance ratio is selected (S105). Note that the luminance ratio stated above will be described later.

The control device executes RGB conversion using a known method (using an inversed matrix defined by the coordinates of R, G and B points and the coordinates of a white point) on the coordinates in the XYZ color coordinate system such that the subpixels of four colors of R, G, B1 and B2 have the luminance ratio corresponding to the selected driving condition (S106), and generates R, G, B1 and B2 data from RGB data (S107). Thereafter, the subpixels of four colors of R, G, B1 and B2 are driven based on the generated R, G, B1 and B2 data.

Specifically, a control device (control unit) 400 executes switching between a first driving condition and a second driving condition, as conditions for driving the pixels, in accordance with a color of a pixel to be displayed. The control device 400 drives both the subpixel of the specific color and the subpixel of the similar color so as to emit light with a first luminance ratio in the first driving condition. And the control device 400 drives both the subpixel of the specific color and the subpixel of the similar color so as to emit light with a second luminance ratio different from the first luminance ratio in the second driving condition.

Though a driving condition is selected depending on whether the color to be displayed is within the region 1 or the region 2 to change the amount of B2 subpixels to be used, the luminance ratio of B2 subpixels may preferably be adjusted in accordance with the degrading of an organic EL material for B2, since the organic EL material for B2 has the shortest lifetime. Moreover, in the case where input data is a still image, color edge is more easily recognizable compared to the case of a moving image, it is preferable to reliably suppress the color edge by increasing the luminance ratio of the B2 subpixels. Furthermore, in the case where the organic EL display device can be operated in multiple display modes such as a "vivid mode" or "cinema mode" and where the display mode is a mode for seeking color reproducibility such as a "vivid mode," it is preferable to enhance color reproducibility by increasing the luminance ratio of B2 subpixels. Thus, in addition to the determination on a region to which the color to be displayed belongs, the control device may determine, as needed, if the organic EL material for B2 is deteriorated, may determine if an object to be displayed is a still image or a moving image, or may determine if the display mode is a "vivid mode" based on, for example, the driving time for B2 subpixels or the output from an optical sensor pre-installed in the organic EL display device, to adjust the luminance ratio of the B2 subpixels under each driving condition in accordance with a determination result.

Figure 14:
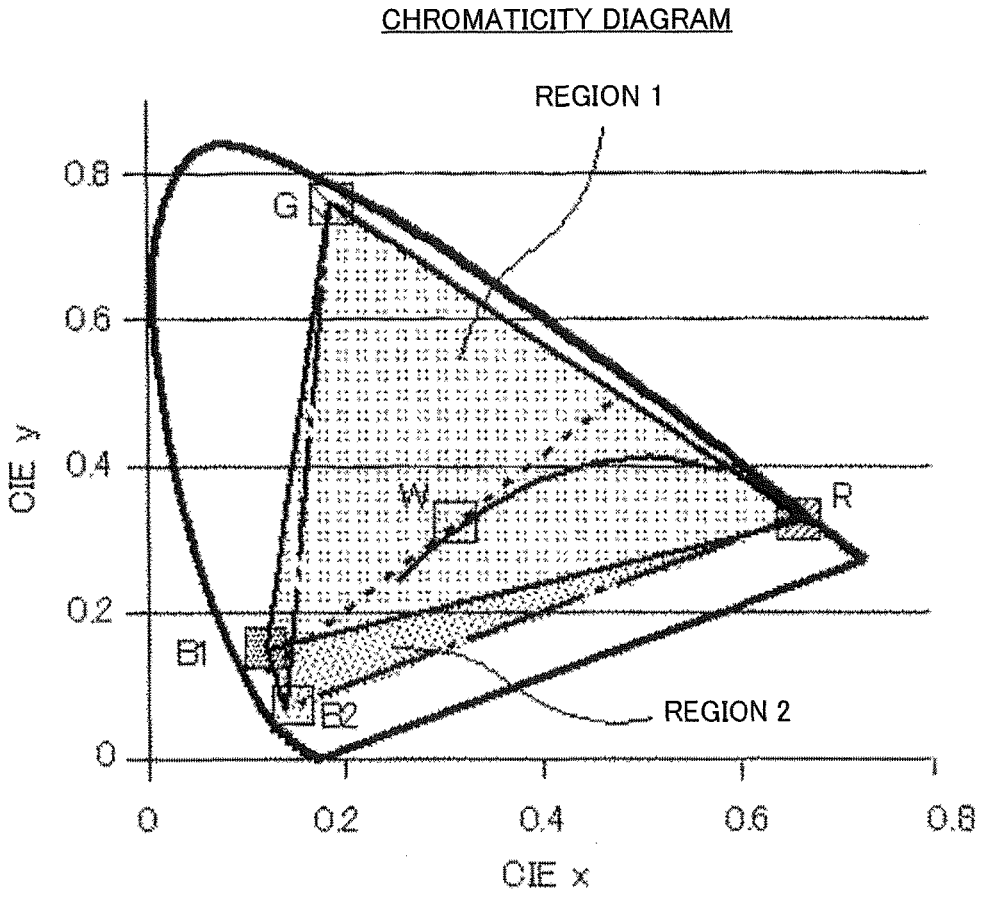
FIG. 14 is a chromaticity diagram illustrating an example of a simulation in which data (R, G, B1 and B2 data) for driving a pixel is calculated according to an embodiment.
Figure 16:
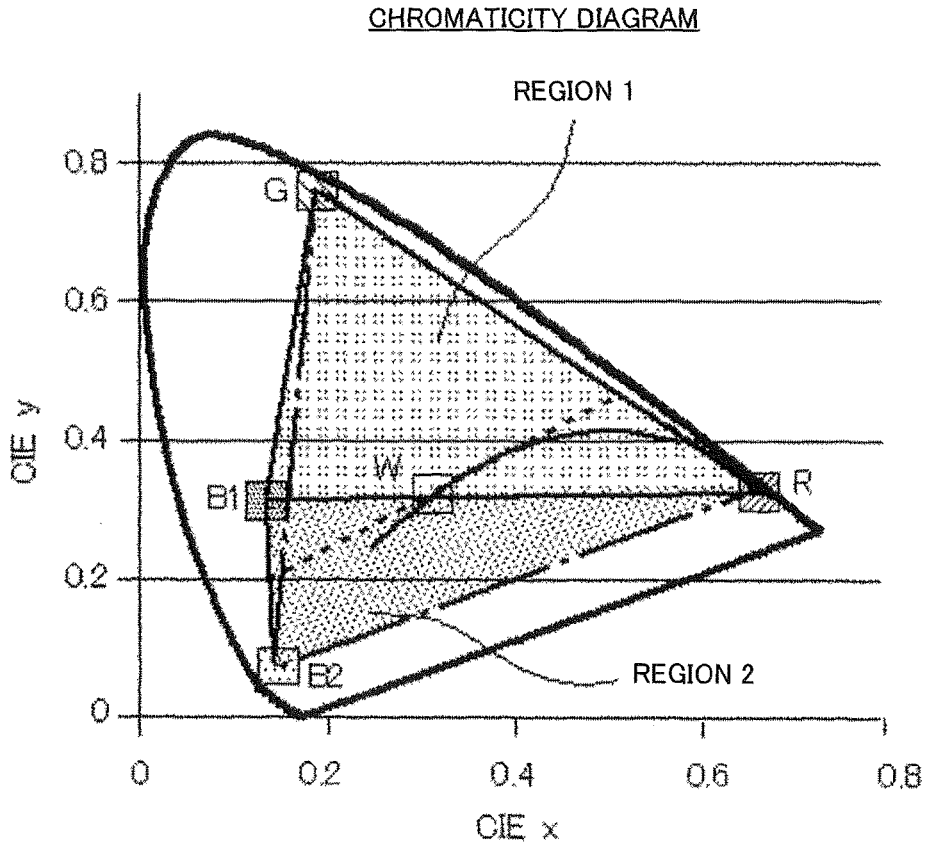
FIG. 16 is a chromaticity diagram illustrating another example of a simulation in which data (R, G, B1 and B2 data) for driving a pixel is calculated according to an embodiment.
Figure 18:
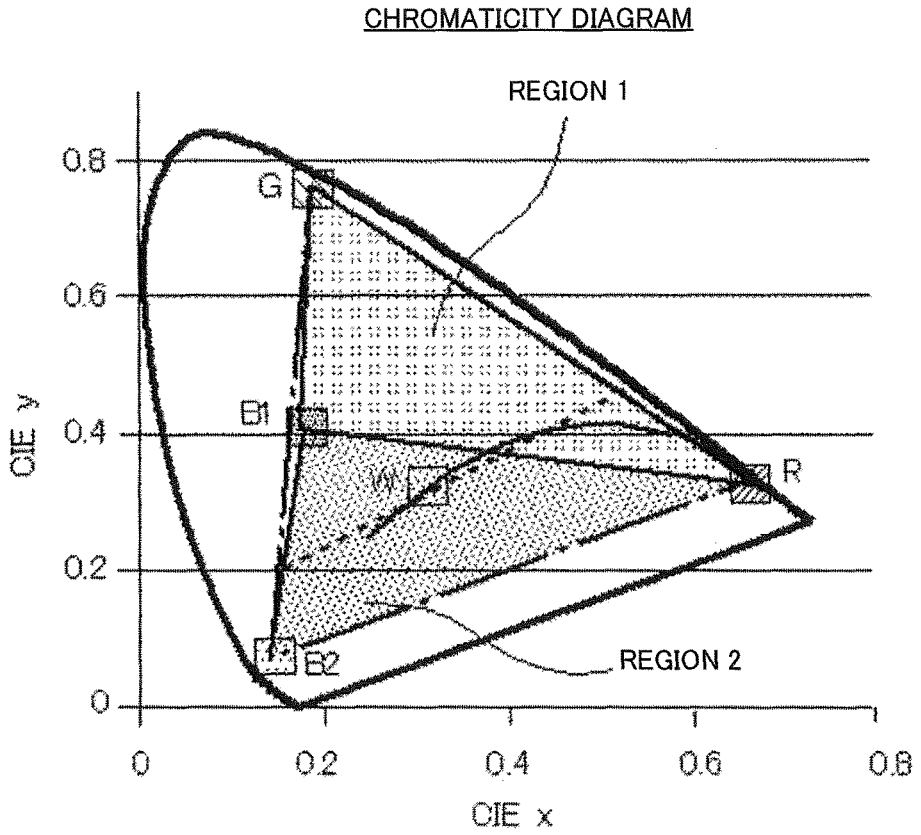
FIG. 18 is a chromaticity diagram illustrating another example of a simulation in which data (R, G, B1 and B2 data) for driving a pixel is calculated according to an embodiment.

Next, a specific calculation method for R, G, B1 and B2 data will be described in detail with reference to FIGS. 13 to 18. Each of FIGS. 13 A, 13 B, 15 A, 15 B 17 A, and 17 B illustrates a table illustrating conditions for calculating R, G, B1 and B2 data as well as simulation results. Moreover, each of FIGS. 14, 16 and 18 is a chromaticity diagram for explaining simulation results, in which the positions of colors of R, G, B1, B2 and W are illustrated with squares. Note that FIGS. 13 A, 13 B, and 14 illustrate the case where the luminance for the subpixel of B1 is lower than the luminance for the subpixel of R (a configuration corresponding to FIG. 9), FIGS. 15 A, 15 B, and 16 illustrate the case where the luminance for the subpixel of B1 is substantially equal to the luminance for the subpixel of R, and FIGS. 17 A, 17 B, and 18 illustrate the case where the luminance for the subpixel of B1 is higher than the luminance for the subpixel of R (a configuration corresponding to FIG. 10).

First, as a precondition for simulation, the aperture ratio for the subpixels of R, G, B1 and B2 (ratio of the area of a light emitting region to the area occupied by subpixels) corresponds to the same value (8% here), while the hue and luminous efficacy of the subpixel of B1 are changed without changing the hues (CIEx, CIEy) and the luminous efficacy (LE) of the subpixels of R, G and B2 (organic EL materials with different characteristics are used).

In the specific calculation procedures for R, G, B1 and B2 data, first, a position (indicated as B') on a line connecting B1 and B2 on the chromaticity diagram is designated, and then B1 and B2 are virtually integrated. Due to the positional relationship between B', B1 and B2 on the chromaticity diagram, the luminance ratio of B1 to B2 may be determined. Next, the color temperature of W is designated. Since the luminance ratio of R, G and B' for displaying W with the color temperature may be uniquely defined, the luminance ratio of R, G, B1 and B2 for displaying W may be determined using the luminance ratio of B1 and B2 decided as described above. Then, when the luminance for W is designated, the luminance is determined for R, G, B1 and B2, and the luminance is divided by the luminous efficacy to obtain driving current for R, G, B1 and B2. Here, the driving current of B2 is changed when the position of B' on the chromaticity diagram is changed, the position of B' is changed with respect to the organic EL materials for B1 having various characteristics to decide a condition in which the driving current of B2 is lowered.

FIGS. 13 A, 13 B, and 14 illustrate the case where a material having a characteristic of CIEx=0.114, CIEy=0.148 and LE=22.5 is used as the organic EL material for B1. In the case of the organic EL material, as the CIEy value of B1 is smaller compared to R while W is within the region 1, the color within the region 1 can be represented only by R, G and B1. According to the present embodiment, however, in order to alleviate the displacement of the luminance center while ensuring a long lifetime and to suppress the occurrence of color edge, R, G, B1 and B2 is operated under the first driving condition in which B2 is used at or below constant current. For example, when CIEy of B' is set at 0.125, the driving current of B2 will be the smallest value in this material characteristic (2.13 mA/cm$^2$ in the case where W of 6500K emits light at the luminance of 450 nit(cd/m$^2$)), resulting in the luminance ratio of R, G, B1 and B2 as illustrated in FIGS. 13 A and 13 B. Moreover, while it is necessary to use B2 for the color within the region 2, the lifetime of B2 is shortened if B2 strongly emits light, so that R, G, B1 and B2 are operated under the second driving condition in which G also emits light supplementarily to ensure the luminance. However, since the burden on B2 is increased in order to keep the color balance if G emits light strongly, it is preferable to set the driving current of G in consideration of the balance between the reliability and visibility.

FIGS. 15 A, 15 B, and 16 illustrate the case where a material having a characteristic closer to G than in the case of FIGS. 13 A, 13 B, and 14 (CIEx=0.130, CIEy=0.300, LE=30) is used as the organic EL material for B1. In the case of the organic EL material, as the CIEy value of B1 is close to R while W is at the end of the region 1, R, G, B1 and B2 are operated under the first driving condition in which B2 is more positively used compared to the examples in FIGS. 13 A, 13 B, and 14 in order to keep the color balance. For example, when CIEy for B' is set at 0.2, the driving current for B2 will be the lowest value in this material characteristic (3.75 mA/cm$^2$ in the case where W of 6500K emits light at the luminance of 450 nit(cd/m$^2$)), resulting in the luminance ratio of R, G, B1 and B2 as illustrated in FIGS. 15 A and 15 B. Moreover, as to the color within the region 2, R, G, B1 and B2 are operated under the second driving condition in which G emits light more weakly compared to the examples in FIGS. 13 A, 13 B, and 14.

FIGS. 17 A, 17 B, and 18 illustrate the case where a material having a characteristic even closer to G (CIEx=0.180, CIEy=0.420, LE=50) is used as the organic EL material for B1. In the case of the organic EL material, the CIEy value of B1 is larger than R and W is within the region 2, R, G, B1 and B2 are operated under the first driving condition in which the luminance for B1 is lowered by somewhat using B2 for the color within the region 1. Moreover, as to the color within the region 2, it is difficult to keep the balance among the four colors which is optimal for realizing low power consumption and high reliability. R, G, B1 and B2 may, however, be operated, for example, under the second driving condition as illustrated in FIGS. 17 A and 17 B.

Next, a rendering method in the subpixel arrangement according to the present embodiment is described with reference to FIGS. 19 to 22. FIGS. 19 to 22 illustrate error diffusion in the subpixel arrangement (luminance: G>R>B1>B2) in FIG. 9, in which the subpixels of the respective colors of R, G, B1 and B2 are formed in the same shape while the rows and columns have the same height and width in order to clarify the error diffusion. In the subpixel arrangement according to the present embodiment, the subpixels of a color having the highest luminance (G here) are located at ends of the pixel, which tends to generate color edge. Then, in order to suppress the influence thereof particularly for "isolated dot", "line" and "boundary" patterns of the displayed image, error diffusion is performed on the adjacent pixels of the patterns.

Figure 19:
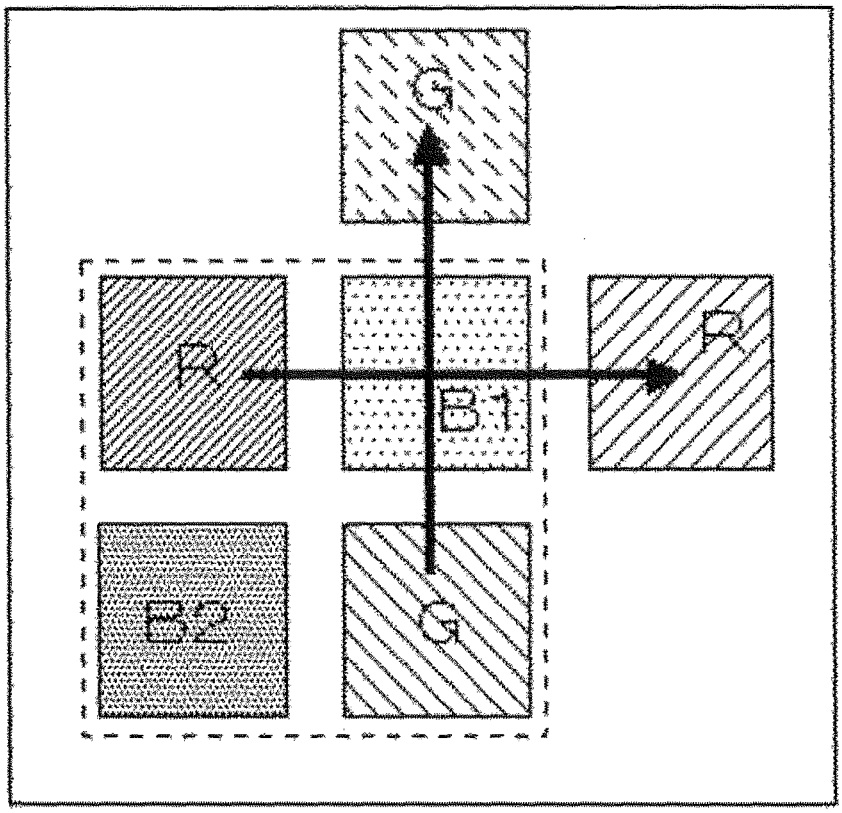
FIG. 19 is a schematic diagram illustrating an example of error diffusion (particularly addressing color edge prevention) in the case of one dot display in the subpixel arrangement in FIG. 9.
Figure 20:
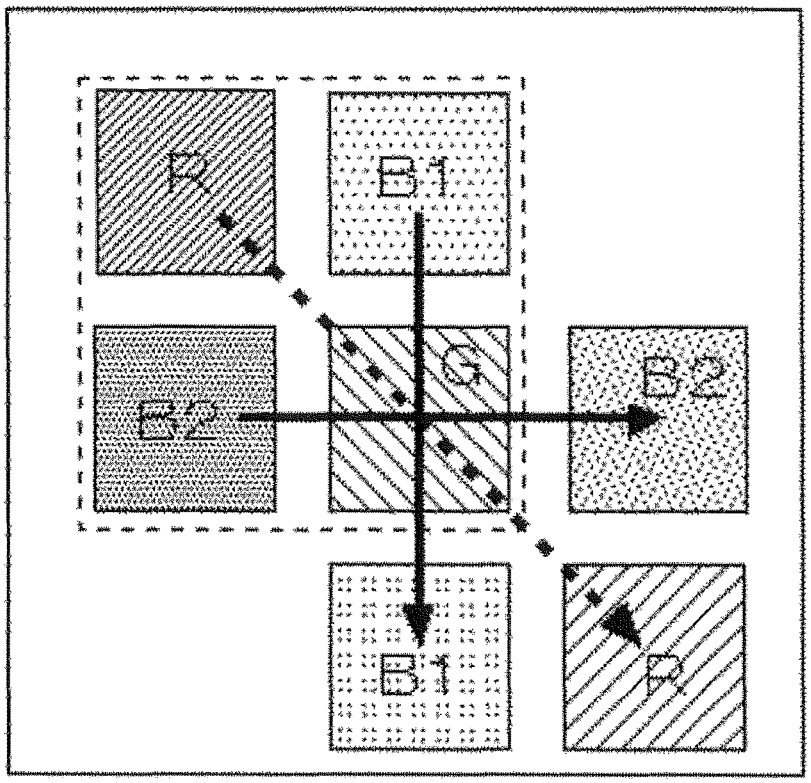
FIG. 20 is a schematic diagram illustrating an example of error diffusion (particularly addressing sharpness) in the case of one dot display in the subpixel arrangement in FIG. 9.

Each of FIGS. 19 and 20 illustrates an example of error diffusion suitable for a dot display (white dot display) corresponding to one pixel. A method of error diffusion is different depending on how the display is to be improved.

FIG. 19 is an example of error diffusion in the case where color edge prevention is specifically addressed. As described above, according to the driving method in the present embodiment, since the luminance for the subpixel of B2 is lowered, the center of luminance is located closer to the B1 subpixel side, which tends to generate color edge. When it is desired to effectively suppress the color edge, error diffusion is performed on the adjacent subpixels with the subpixel of B1 interposed in between (here, the subpixel of G in the adjacent pixel on the upper side and the subpixel of R in the adjacent pixel on the right side). For example, the luminance for the subpixel of G in the pixel to be displayed is reduced to approximately 90%, and the luminance corresponding to the reduced amount is assigned to the subpixel of G in the adjacent pixel on the upper side. Similarly, the luminance for the subpixel of R in the pixel to be displayed is reduced to approximately 95%, and the luminance corresponding to the reduced amount is assigned to the subpixel of R in the adjacent pixel on the right side.

FIG. 20 is an example of error diffusion in the case where sharpness of the displayed image is particularly addressed. In the case where sharpness is particularly addressed, when error diffusion is performed on colors (B1 and B2 here) adjacent to the color (G here) having the highest luminance, the color having the highest luminance may be highlighted. In this case, error diffusion is performed on the adjacent subpixels with the subpixel of G interposed in between (here, the subpixel of B1 in the adjacent pixel on the lower side and the subpixel of B2 in the adjacent pixel on the right side). For example, the luminance for the subpixel of B1 in the pixel to be displayed is reduced to approximately 90%, and the luminance corresponding to the reduced amount is assigned to the subpixel of B1 in the adjacent pixel on the lower side. Similarly, the luminance for the subpixel of B2 in the pixel to be displayed is reduced to approximately 95%, and the luminance corresponding to the reduced amount is assigned to the subpixel of B2 in the adjacent pixel on the right side. Furthermore, for the subpixel of R in the adjacent pixel on the lower right side, it is also possible to perform error diffusion for approximately a few %.

Figure 21:
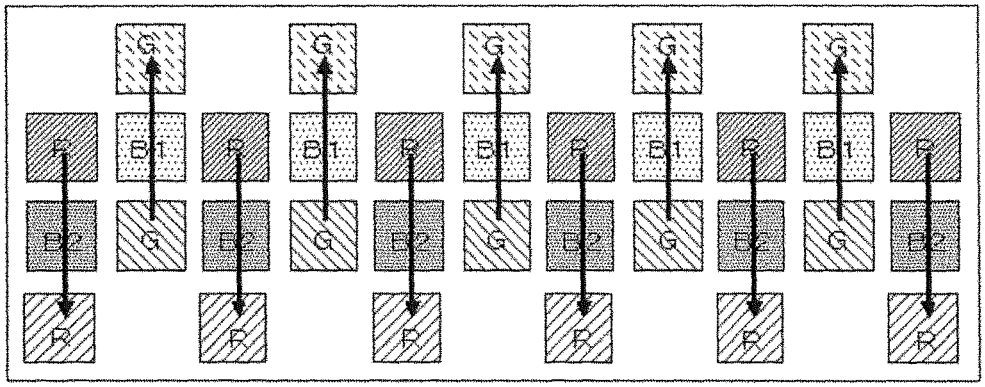
FIG. 21 is a schematic diagram illustrating an example of error diffusion (particularly addressing color edge prevention) in the case of one line display in the subpixel arrangement in FIG. 9.
Figure 22:
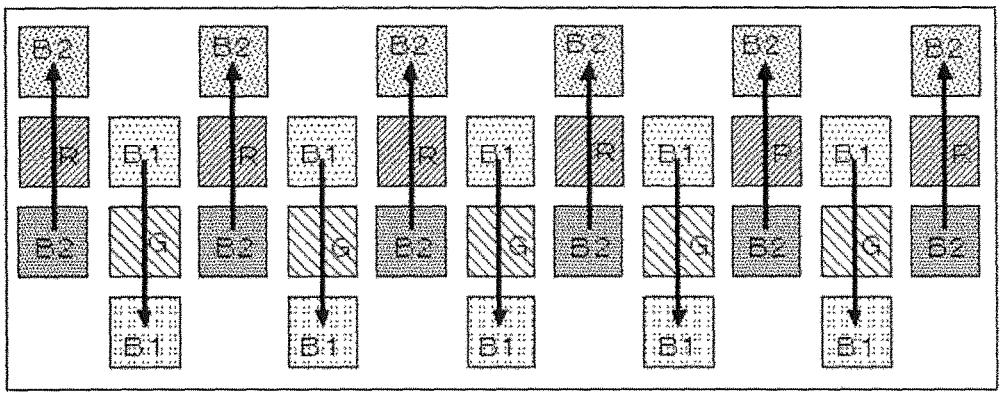
FIG. 22 is a schematic diagram illustrating an example of error diffusion (particularly addressing sharpness) in the case of one line display in the subpixel arrangement in FIG. 9.

Each of FIGS. 21 and 22 illustrates an example of a rendering method suitable for a display for one line (white line display), and the method of error diffusion is different depending on how the display is to be improved.

FIG. 21 is an example of error diffusion in the case where color edge prevention is particularly addressed. As described above, according to the present embodiment, by lowing the luminance for subpixels of B1 and B2, G and R stand out, which tends to generate color edge. When it is desired to effectively suppress the color edge, error diffusion is performed on the adjacent subpixel with the subpixel of B1 interposed in between (here, the subpixel of G in the adjacent pixel on the upper side) and the adjacent subpixel with the subpixel of B2 interposed in between (here, the subpixel of R in the adjacent pixel on the lower side). For example, the luminance for the subpixel of G in the pixel to be displayed is reduced, and the luminance corresponding to the reduced amount is assigned to the subpixel of G in the adjacent pixel on the upper side. Similarly, the luminance for the subpixel of R in the pixel to be displayed is reduced, and the luminance corresponding to the reduced amount is assigned to the subpixel of R in the adjacent pixel on the lower side.

While FIG. 21 illustrates an example where lines are displayed, it is sufficient to perform error diffusion only on the adjacent pixels on one side in the case of an edge. Furthermore, FIG. 21 is an example where white lines are displayed, error diffusion may be performed in the direction in which the luminance for adjacent pixels on the outer side is reduced in the case of displaying a black line. For example, the luminance for the subpixel of G in the adjacent pixel on the upper side is reduced, and the luminance corresponding to the reduced amount may be assigned to the subpixel of G in the pixel to be displayed. Similarly, the luminance for the subpixel of R in the adjacent pixel on the lower side is reduced, and the luminance corresponding to the reduced amount may be assigned to the subpixel of R in the pixel to be displayed.

FIG. 22 is an example of error diffusion in the case where sharpness is particularly addressed. In the case where sharpness is particularly addressed, if error diffusion is performed on colors (B1 and B2 here) adjacent to a color with high luminance (G and R here), the color with high luminance may be highlighted. In this case, error diffusion may be performed on the adjacent subpixel with the subpixel of G interposed in between (here, subpixel of B1 in the adjacent pixel on the lower side) and the adjacent subpixel with the subpixel of R interposed in between (here, subpixel of B2 in the adjacent pixel on the upper side). For example, the luminance for the subpixel of B1 in the pixel to be displayed is reduced, and the luminance corresponding to the reduced amount is assigned to the subpixel of B1 in the adjacent pixel on the lower side. Similarly, the luminance for the subpixel of B2 in the pixel to be displayed is reduced, and the luminance corresponding to the reduced amount is assigned to the subpixel of B2 in the adjacent pixel on the upper side. Similarly to the above, FIG. 22 is an example where lines are displayed, while error diffusion may be performed only on adjacent pixels on one side in the case of an edge.

Figure 23:
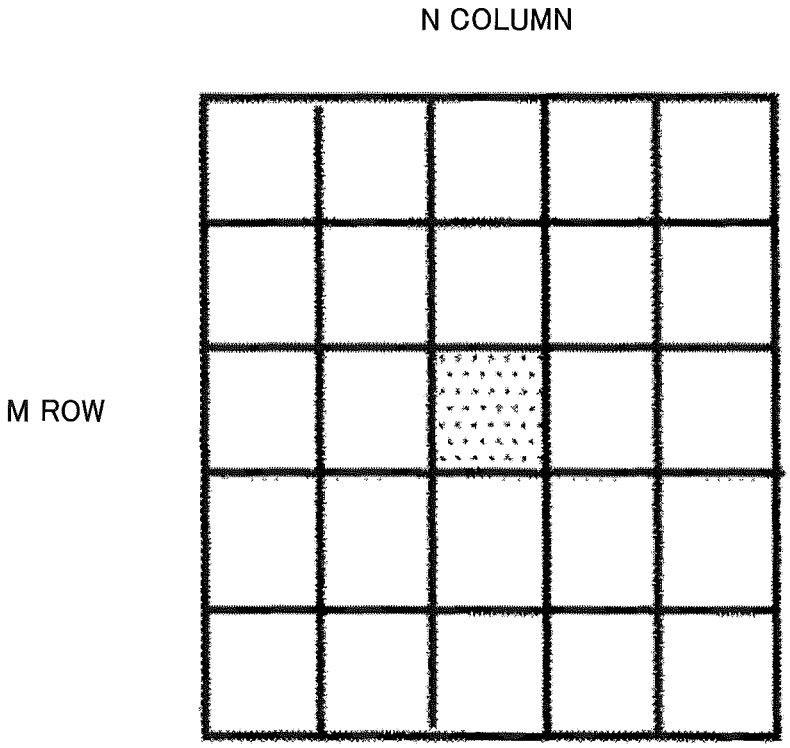
FIG. 23 is a view for illustrating a method of detecting a singularity such as a corner, a straight line, a dot or the like in a display image.

To perform the rendering method as described above, it is necessary to perform error diffusion processing on a displayed image while distinguishing and recognizing which part of the displayed image corresponds to a singularity such as a corner, a boundary or a dot. For example, as illustrated in FIG. 23, in the case where image processing is performed with a matrix of M×N (5×5 here), identification is performed according to a group classification table assuming a 5×5 luminance distribution pattern with respect to the subpixel at the center. As a result, in the case where the subpixel at the center is recognized as a singularity such as a corner, a boundary, a point or the like, data for the subpixel at the center and the subpixels in the periphery thereof is processed based on the error diffusion processing table corresponding to the respective singularities. The processed data is then saved in a line memory for a displayed image. In this method, a line memory corresponding to M×2 rows allows a displayed image to be outputted while sequentially being scanned, which eliminates the need for a separate dedicated frame memory for image processing. That is, the rendering method as described above can be realized with a very small circuitry system.

First Example

Next, an electro optical device according to the first example will be described with reference to FIG. 24 to FIG. 31.

While the pixel arrangement structure in the electro optical device (organic EL display device) has specifically been described in the embodiment as described above, the present example describes a method of manufacturing an organic EL display device including a pixel array having the pixel arrangement structure as described above. FIGS. 24, 26, 28 and 30 are plan views of one pixel with the pixel arrangement structure illustrated in FIG. 9, whereas FIGS. 25, 27, 29 and 31 are section views of specially extracting a TFT part, a retention capacitance part and a light emitting element illustrated in one subpixel for explanation purpose, corresponding to FIGS. 24, 26, 28 and 30.

Figure 24:
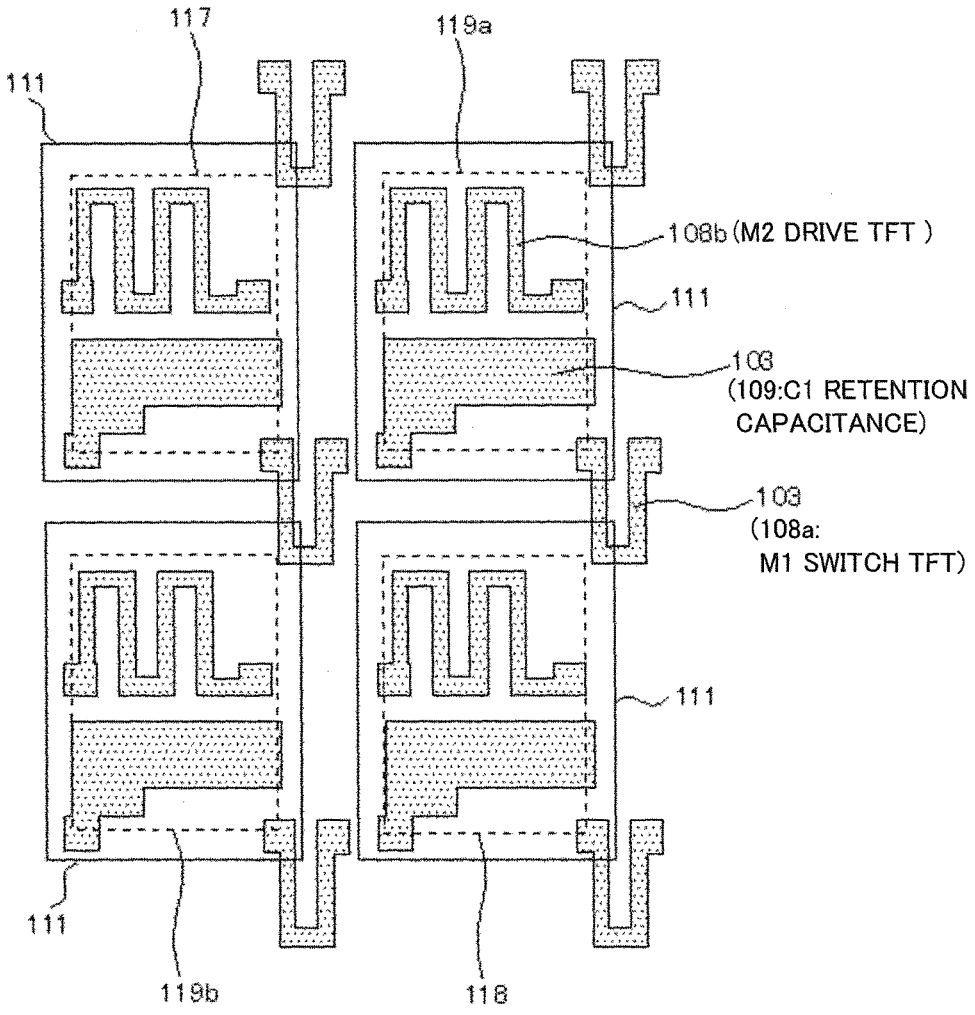
FIG. 24 is a plan view illustrating a manufacturing step (first step) of an organic EL display device according to the first example.
Figure 25:
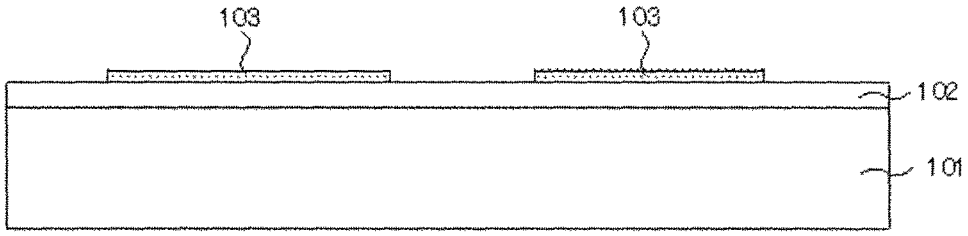
FIG. 25 is a section view illustrating a manufacturing step (first step) of an organic EL display device according to the first example.

First, as illustrated in FIGS. 24 and 25, an underlying insulation film 102 is formed by depositing, for example, a silicon nitride film using, for example, chemical vapor deposition (CVD) method on a translucent substrate made of glass or the like (glass substrate 101). Next, a TFT part and a retention capacitance part are formed using a known low-temperature poly silicon TFT fabrication technique. More specifically, the CVD method or the like is used to deposit amorphous silicon, which is crystallized by excimer laser annealing (ELA) to form a poly silicon layer 103. Here, in order to secure a sufficient channel length of the M2 drive TFT 108*b* which is used as a voltage-to-current conversion amplifier to suppress variation in output current, and to enable the connection between the source of the M1 switch TFT 108*a* and the data line 107*a*, the connection between the drain of the M1 switch TFT 108*a* and the retention capacitance part 109, the connection between the retention capacitance part 109 and the power supply line 107*b*, the connection between the source of the M2 drive TFT 108*b* and the power supply line 107*b*, and the connection between the drain of the M2 drive TFT 108*b* and the anode electrode 111 of each subpixel, the poly silicon layer 103 is routed as illustrated. In FIG. 24, in order to clarify the positions of the M1 switch TFT 108*a*, M2 drive TFT 108*b* and retention capacitance part 109, the anode electrode 111 is indicated with a solid line, while the R light-emitting region 117, G light-emitting region 118, B1 light-emitting region 119*a* and B2 light-emitting region 119*b* are indicated with broken lines.

Figure 26:
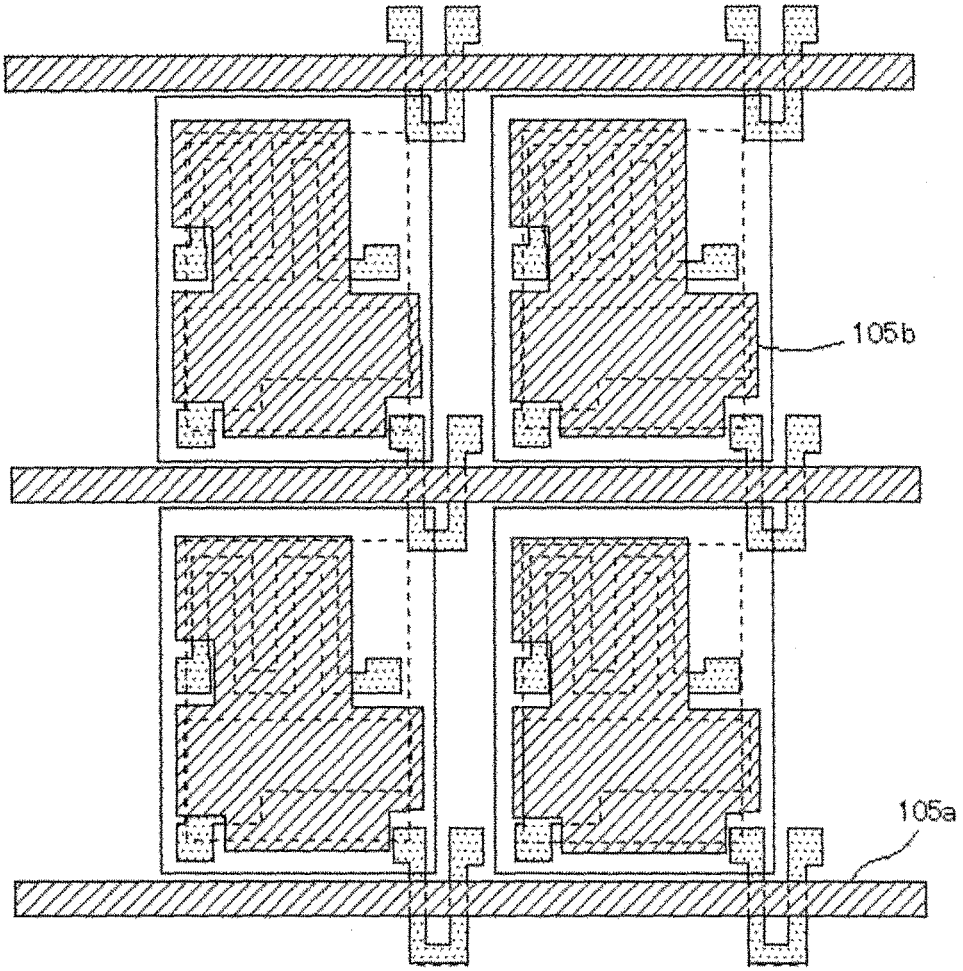
FIG. 26 is a plan view illustrating a manufacturing step (second step) of an organic EL display device according to the first example.
Figure 27:
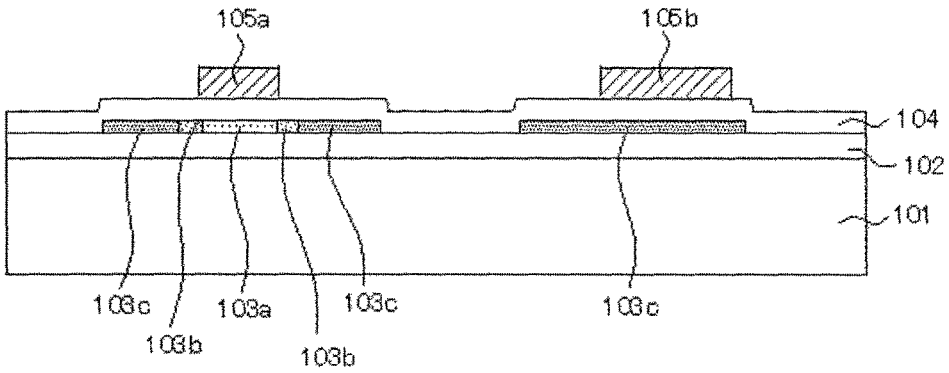
FIG. 27 is a section view illustrating a manufacturing step (second step) of an organic EL display device according to the first example.

Next, as illustrated in FIGS. 26 and 27, a gate insulation film 104 is formed by depositing, for example, a silicon oxide film using the CVD method or the like on the poly silicon layer 103, and a gate electrode 105*a* and a retention capacitance electrode 105*b* are formed by further depositing, for example, molybdenum (Mo), niobium (Nb), tungsten (W) or an alloy thereof as the first metal layer 105 by the spattering technique. It is also possible to form the first metal layer 105 with a single layer of one substance selected from a group including, for example, Mo, W, Nb, MoW, MoNb, Al, Nd, Ti, Cu, Cu alloy, Al alloy, Ag and Ag alloy, or with a layered structure selected from a group including a two or more multi-layered structure of Mo, Cu, Al or Ag which is a low-resistance substance so as to reduce the interconnection resistance. Here, in order to increase the retention capacitance in each subpixel while facilitating the connection between the drain of the M1 switch TFT 108*a* and the retention capacitance electrode 105*b* in each subpixel, the first metal layer 105 is formed to have the shape as illustrated. Next, additional impurity doping is applied to the poly silicon layer 103, which had been doped with a heavily-concentrated impurity layer (p+layer 103*c*) prior to formation of the gate electrode, using the gate electrode 105*a* as a mask to form a lightly-concentrated impurity layer (p−layer 103*b*) with an intrinsic layer (i layer 103*a*) being sandwiched, so as to form a lightly doped drain (LDD) structure in the TFT part.

Figure 28:
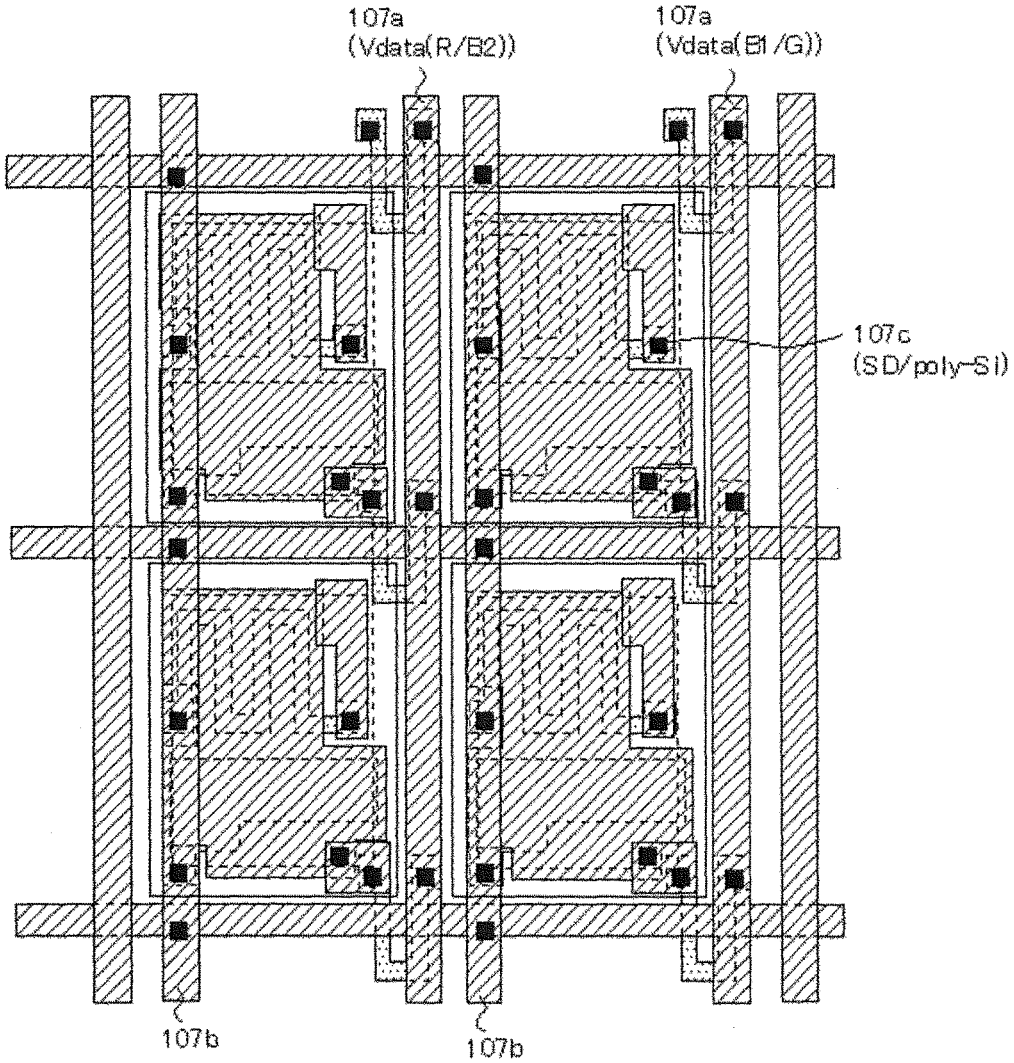
FIG. 28 is a plan view illustrating a manufacturing step (third step) of an organic EL display device according to the first example.
Figure 29:
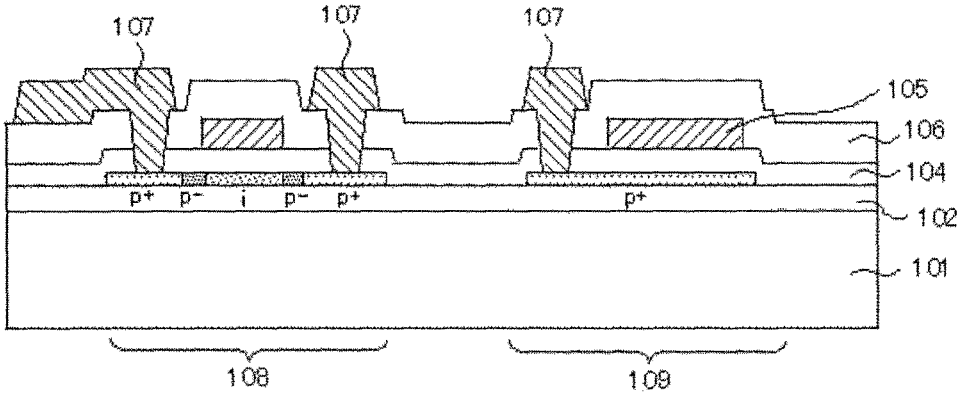
FIG. 29 is a section view illustrating a manufacturing step (third step) of an organic EL display device according to the first example.

Next, as illustrated in FIGS. 28 and 29, the CVD method or the like is used to deposit, for example, a silicon oxide film to form an interlayer insulation film 106. Anisotropic etching is performed on the interlayer insulation film 106 and the gate insulation film 104, to open a contact hole for connection to the poly silicon layer 103 and a contact hole for connection to the power supply line 105*c*. Next, using the spattering technique, the second metal layer 107 made of, for example, aluminum alloy such as Ti/Al/Ti is deposited, and patterning is performed to form the source/drain electrode, the data line 107*a*, the power supply line 107*b*, and the first contact part 107*c* (rectangle part colored in black). This allows connection between the data line 107*a* and the source of the M1 switch TFT 108*a*, between the drain of the M1 switch TFT 108*a* and the retention capacitance electrode 105*b* as well as the gate of the M2 drive TFT 108*b*, and between the source of the M2 drive TFT 108*b* and the power supply line 107*b*.

Figure 30:
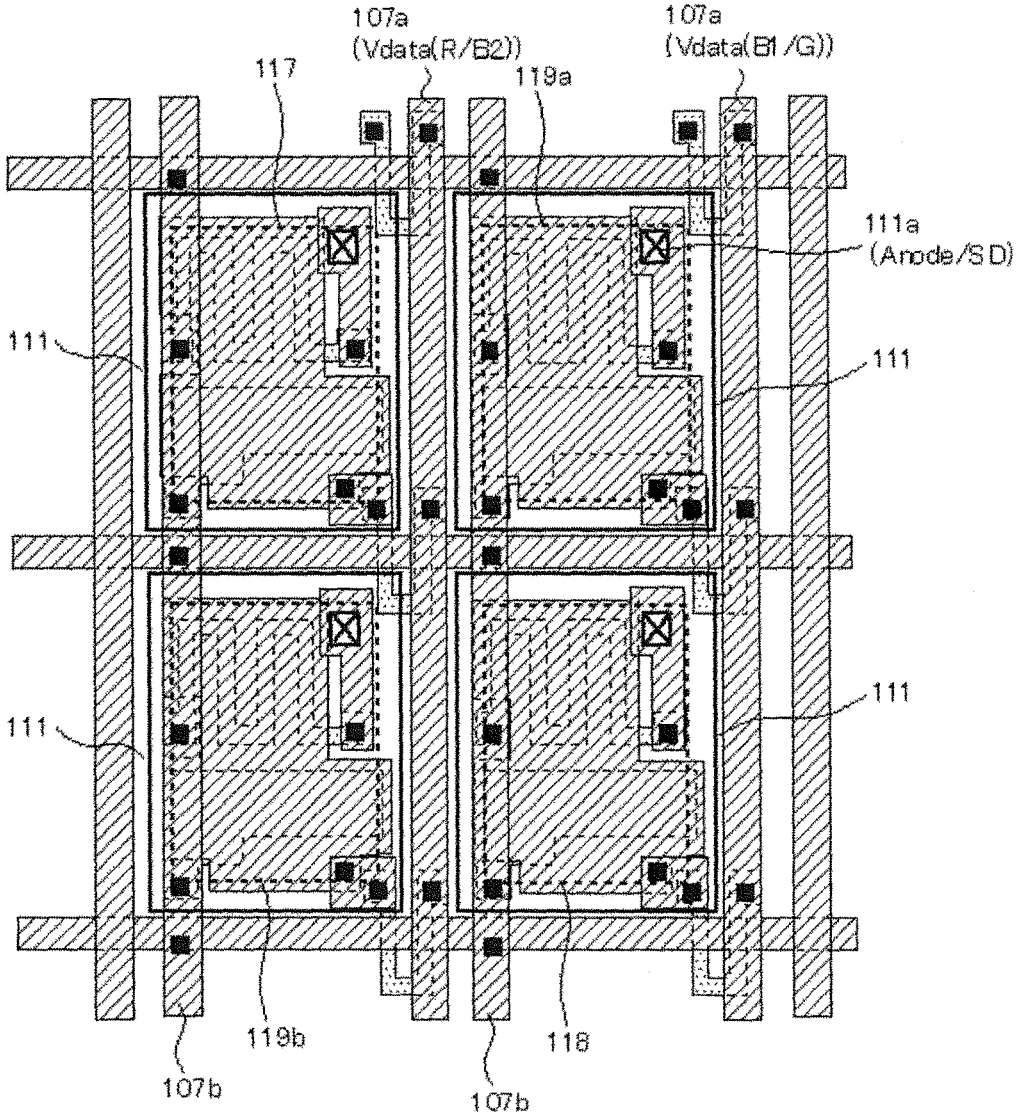
FIG. 30 is a plan view illustrating a manufacturing step (fourth step) of an organic EL display device according to the first example.
Figure 31:
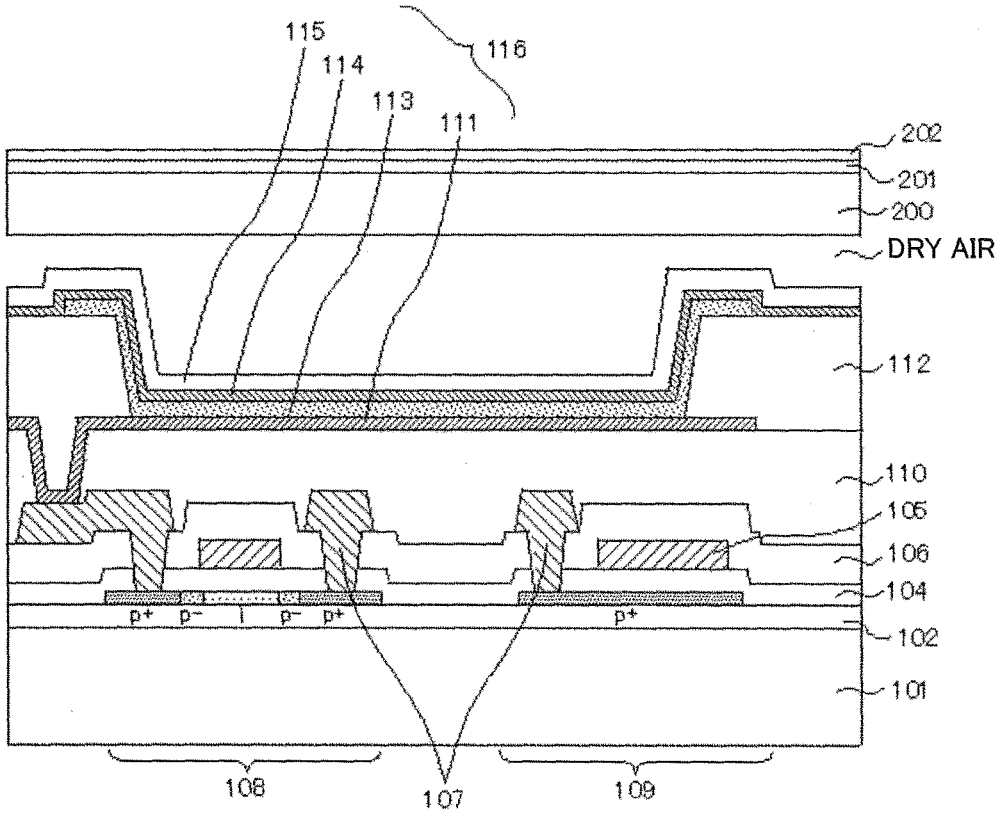
FIG. 31 is a section view illustrating a manufacturing step (fourth step) of an organic EL display device according to the first example.

Next, as illustrated in FIGS. 30 and 31, a photosensitive organic material is deposited to form a planarization film 110. The exposing condition is optimized to adjust a taper angle, to open a contact hole (part enclosed by a thick solid line marked with x) for connection to the drain of the M2 drive TFT 108*b*. A reflection film is deposited thereon with metal of Ag, Mg, Al, Pt, Pd, Au, Ni, Nd, Ir, Cr or a compound thereof, and subsequently a transparent film of ITO, IZO, ZnO, $In_2O_3$ or the like is deposited thereon, while patterning is performed at the same time to form an anode electrode 111 for each subpixel. The anode electrode 111 is connected to the drain of the M2 drive TFT 108*b* at the second contact part 111*a*. Though the anode electrode 111 requires a reflection film since it also serves as a reflection film (not shown)

in the top emission structure, the reflection film may be eliminated in the case of a bottom emission structure and the anode electrode 111 may be formed only with a transparent film such as ITO. Next, the spin coating technique is used to deposit, for example, a photosensitive organic resin film to form an element isolation layer and then patterning is performed to form an element separation film 112 in which the anode electrode 111 of each subpixel is exposed to the bottom. This element isolation layer serves to isolate the light-emitting region of each subpixel.

Next, the glass substrate 101 on which the element separation film 112 is formed is set in a vapor deposition machine, FMMs on which apertures corresponding to different subpixels are formed are aligned and fixed, and a film of organic EL material is formed for each color of RGB1B2, to form an organic EL layer 113 on the anode electrode 111. The organic EL layer 113 is constituted by, for example, a hole injection layer, a hole transportation layer, a light emission layer, an electron transportation layer, an electron injection layer and the like from the lower layer side. Moreover, the organic EL layer 113 may have any structure of the combinations including: electron transportation layer/light emission layer/hole transportation layer; electron transportation layer/light emission layer/hole transportation layer/hole injection layer; and electron injection layer/electron transportation layer/light emission layer/hole transportation layer, or may be a light emission layer alone, or may also be added with an electron blocking layer or the like. The material for the light emission layer is different for each color of subpixels, while the film thickness of the hole injection layer, the hole transportation layer or the like is individually controlled for each subpixel as needed.

Metal having a small work function, i.e. Li, Ca, LiF/Ca, LiF/Al, Al, Mg or a compound thereof, is vapor-deposited on the organic EL layer 113 to form a cathode electrode 114. The film thickness of the cathode electrode 114 is optimized to increase the light extraction efficiency and to ensure preferable viewing angle dependence. In the case where the cathode electrode 114 has a high resistance thereby losing the uniformity in luminance, an auxiliary electrode layer is added thereon with a substance for forming a transparent electrode such as ITO, IZO, ZnO or $In_2O_3$. Furthermore, in order to improve the light extraction efficiency, an insulation film having a refractive index higher than that of glass is deposited to form a cap layer 115. The cap layer 115 also serves as a protection layer for the organic EL element.

As described above, the light emitting element 116 corresponding to each subpixel of RGB is formed, and a portion where the anode electrode 111 and the organic EL layer 113 are in contact with each other (the aperture part of the element separation film 112) will be the R light-emitting region 117, the G light-emitting region 118, the B1 light-emitting region 119*a* or the B2 light-emitting region 119*b*.

In the case where the light emitting element 116 has a bottom emission structure, the cathode electrode 114 (transparent electrode such as ITO) is formed on the upper layer of the planarization film 110, whereas the anode electrode 111 (reflection electrode) is formed on the organic EL layer 113. Since the bottom emission structure does not require light extraction to the upper surface, a metal film of Al or the like may be formed thick, which can significantly reduce the resistance value of the cathode electrode and thus the bottom emission structure is suitable for a large device. It is, however, not suitable to a highly precise structure due to an extremely small light-emitting region because the TFT element and the wiring part cannot transmit light.

Next, a glass frit coats around the outer circumference of the TFT substrate 100, a sealing glass substrate 200 is mounted thereon, and the glass frit part is heated and melted with laser or the like to tightly seal the TFT substrate 100 and the sealing glass substrate 200. Thereafter, a $\lambda/4$ retardation plate 201 and a polarization plate 202 are formed on the light emission side of the sealing glass substrate 200, to complete the organic EL display device.

While FIGS. 24 to 31 illustrate an example of the method of manufacturing an organic EL display device according to the first example, the manufacturing method is not particularly limited thereto if the pixel arrangement structure described in the embodiment may be realized.

Second Example

Next, an electro optical device and an electric apparatus according to the second example will be described with reference to FIGS. 32 to 35. In the second example, various types of electric apparatus including an organic EL display device as a display means will be described as an application example of the organic EL display device.

Figure 32:
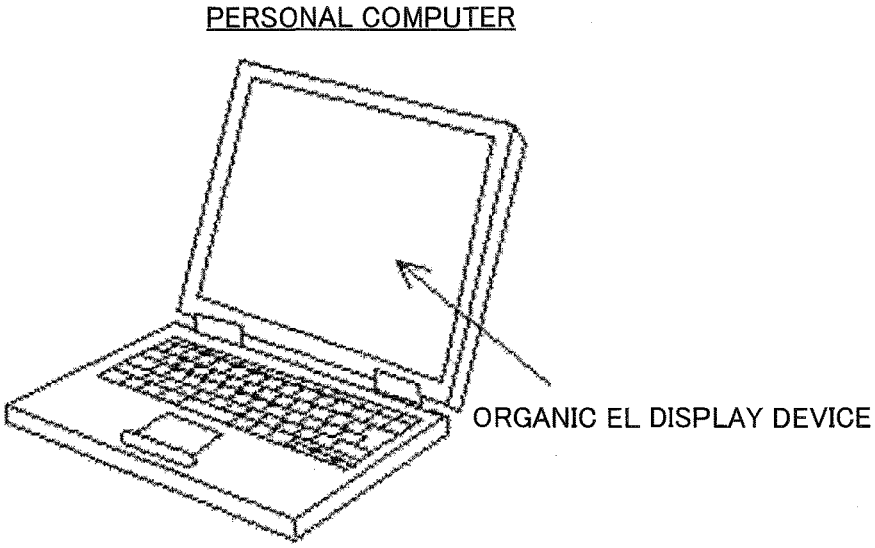
FIG. 32 is a schematic view illustrating an application example of an organic EL display device according to the second example.
Figure 33:
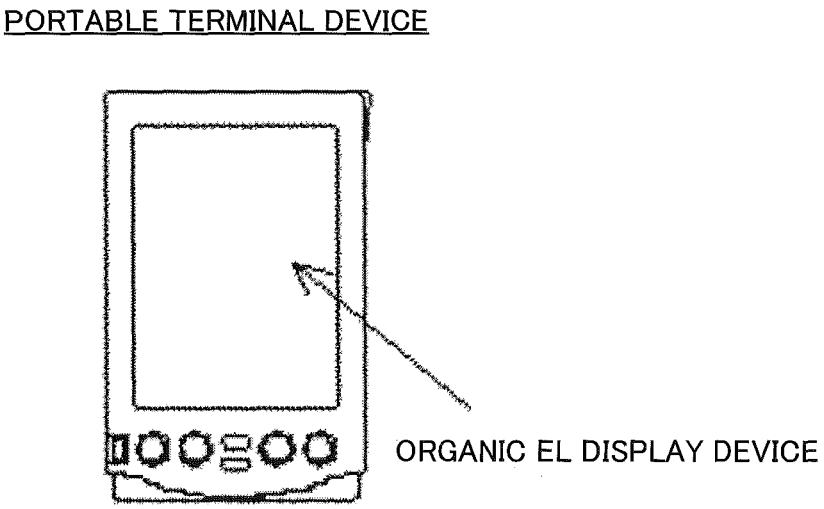
FIG. 33 is a schematic view illustrating an application example of an organic EL display device according to the second example.
Figure 34:
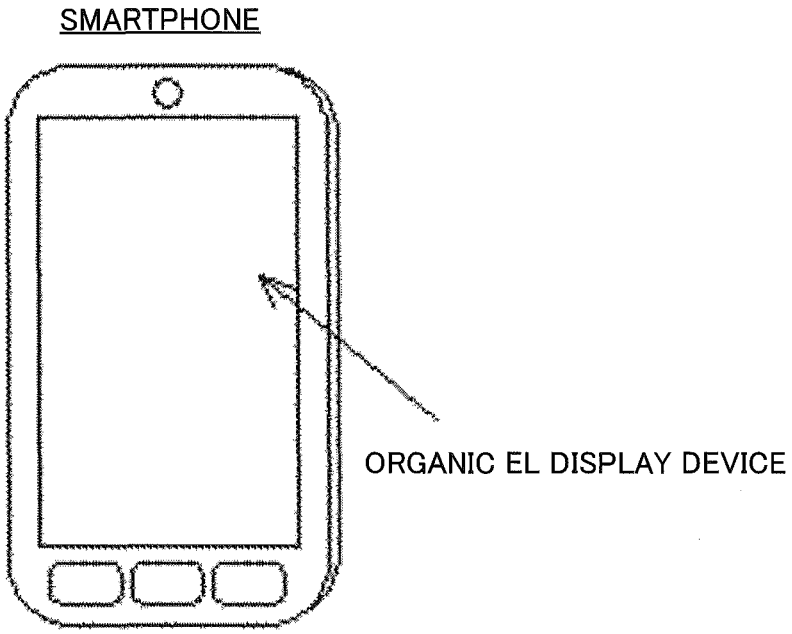
FIG. 34 is a schematic view illustrating an application example of an organic EL display device according to the second example.
Figure 35:
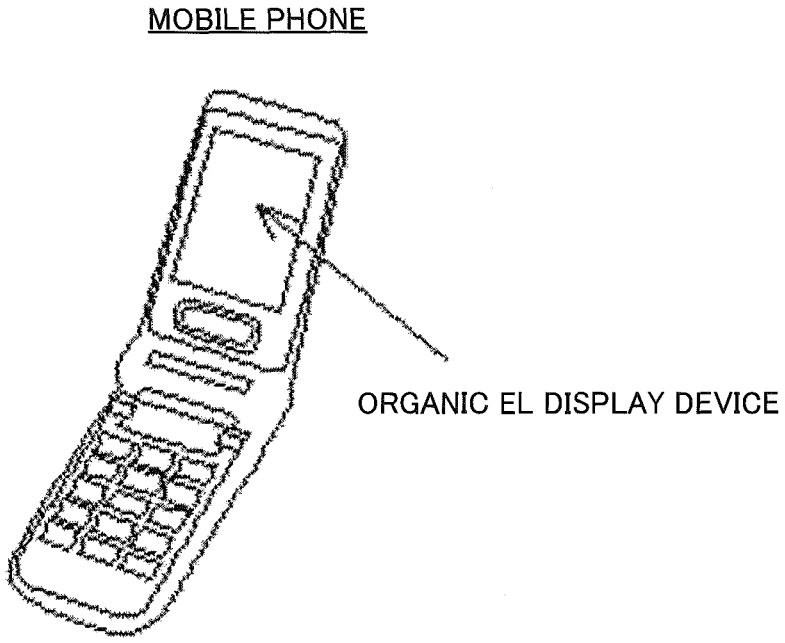
FIG. 35 is a schematic view illustrating an application example of an organic EL display device according to the second example.

FIGS. 32 to 35 illustrate examples of electric apparatus to which an electro optical device (organic EL display device) is applied. FIG. 32 is an example of application to a personal computer, FIG. 33 is an example of application to a portable terminal device such as a personal digital assistant (PDA), an electronic notebook, an electronic book, a tablet terminal, FIG. 34 is an example of application to a smartphone, and FIG. 35 is an example of application to a mobile phone. The organic EL display device may be utilized for a display unit of these types of electric apparatus. Application may be possible to any electric apparatus provided with a display device without specific limitation, for example, to a digital camera, a video camera, a head mounted display, a projector, a facsimile device, a portable TV, a demand side platform (DSP) device and the like.

Third Example

Next, an electro optical device and electric apparatus according to the third example will be described with reference to FIGS. 36 to 39. While a case where the organic EL display device as the electro optical device is applied to electric apparatus provided with a planar display unit is described in the second example above, the organic EL display device may also be applied to electric apparatus requiring a curved display unit by making it deformable.

Figure 36:
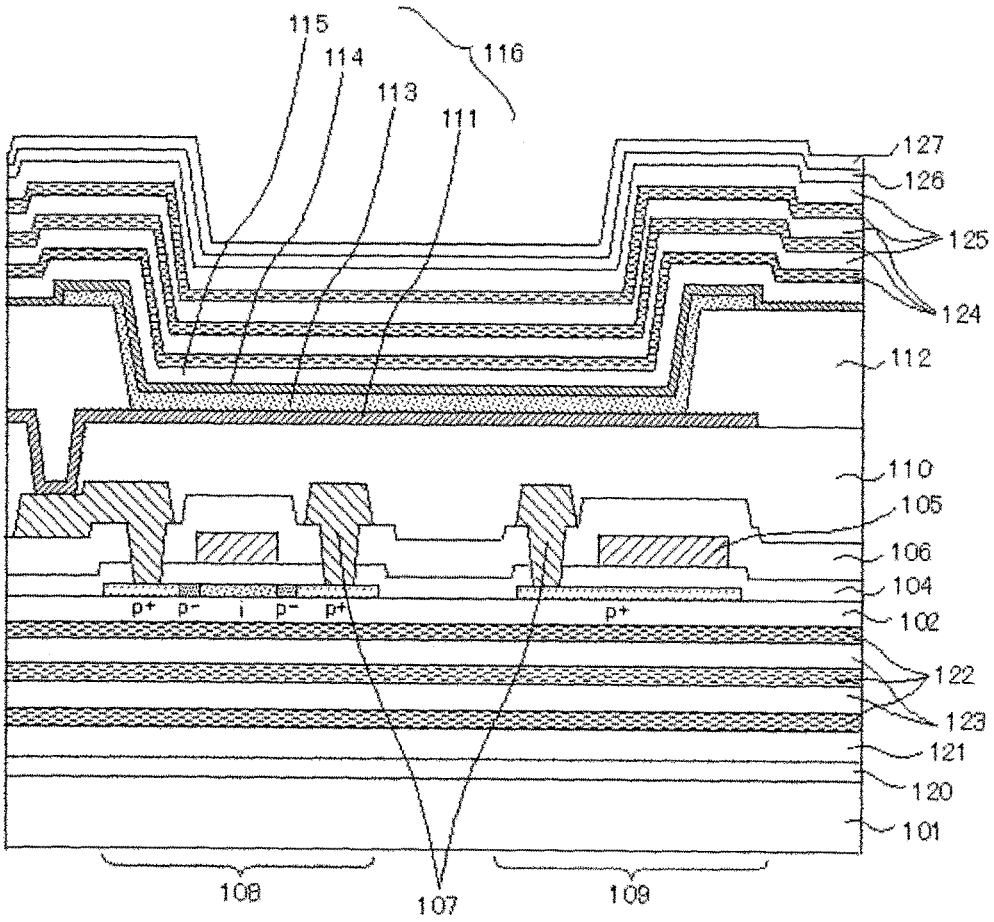
FIG. 36 is a section view schematically illustrating the structure of an organic EL display device according to the third example.

FIG. 36 is a section view illustrating a structure of a deformable organic EL display device. This structure is different from the first example described above in that (1) TFT part 108*a* and 108*b* and retention capacitance part 109 are formed on a flexible substrate, and (2) no sealing glass substrate 200 is arranged on the light emitting element 116.

First, as to (1), a stripping film 120 such as organic resin which can be removed with a stripping solution is formed on a glass substrate 101, and a flexible substrate 121 having flexibility made of, for example, polyimide is formed thereon. Next, an inorganic thin film 122 such as a silicon oxide film or silicon nitride film and an organic film 123 such as organic resin are alternately layered. Then, on the top layer film (inorganic thin film 122 here), an underlying insulation film 102, a poly silicon layer 103, a gate insulation film 104, a first metal layer 105, an interlayer insulation film 106, a second metal layer 107 and a planarization film 110 are sequentially formed, to form a TFT part 108*a* and 108*b* and a retention capacitance part 109, according to the manufacturing method described in the first example.

Moreover, as to (2), the anode electrode 111 and the element separation film 112 are formed on the planarization film 110, and the organic EL layer 113, the cathode electrode 114 and the cap layer 115 are sequentially formed on the bank layer from which the element separation film 112 is removed, to form the light emitting element 116. Thereafter, an inorganic thin film 124 of a silicon oxide film, silicon nitride film or the like and an organic film 125 of organic resin or the like are alternately layered on the cap layer 115, and a λ/4 retardation plate 126 and a polarization plate 127 are formed on the top layer film (organic film 125 here).

Thereafter, the stripping film 120 on the glass substrate 101 is removed with a stripping solution or the like, to detach the glass substrate 101. In this structure, since the glass substrate 101 and the sealing glass substrate 200 are eliminated while the entire organic EL display device is deformable, application may be possible to electric apparatus having different purposes which requires a curved display unit, particularly to wearable electric apparatus.

Figure 37:
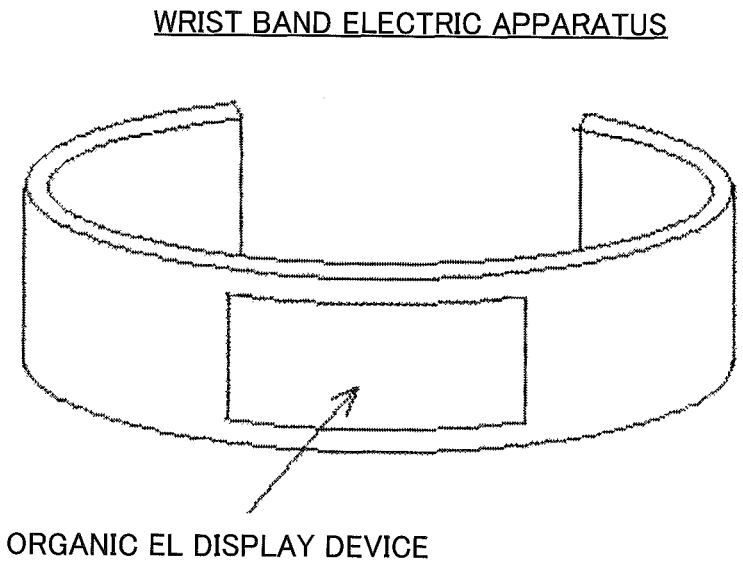
FIG. 37 is a schematic view illustrating an application example of an organic EL display device according to the third example.

For example, the organic EL display device may be utilized for a display unit of wrist band electric apparatus to be attached on a wrist as illustrated in FIG. 37 (terminal linked with a smartphone, terminal provided with a global positioning system (GPS) function, terminal for measuring human body information such as pulse or body temperature, for example). In the case of the terminal linked with a smartphone, a communication means provided in the terminal in advance (short distance wireless communication unit which operates in accordance with a standard such as Bluetooth® or near field communication (NFC)) may be used to display received image data or video data on the organic EL display device. Furthermore, in the case of a terminal provided with a GPS function, it is possible to display the positional information, the moving distance information and the moving speed information specified based on GPS signals on the organic EL display device. Moreover, in the case of a terminal for measuring human body information, the measured information may be displayed on the organic EL display device.

Figure 38:
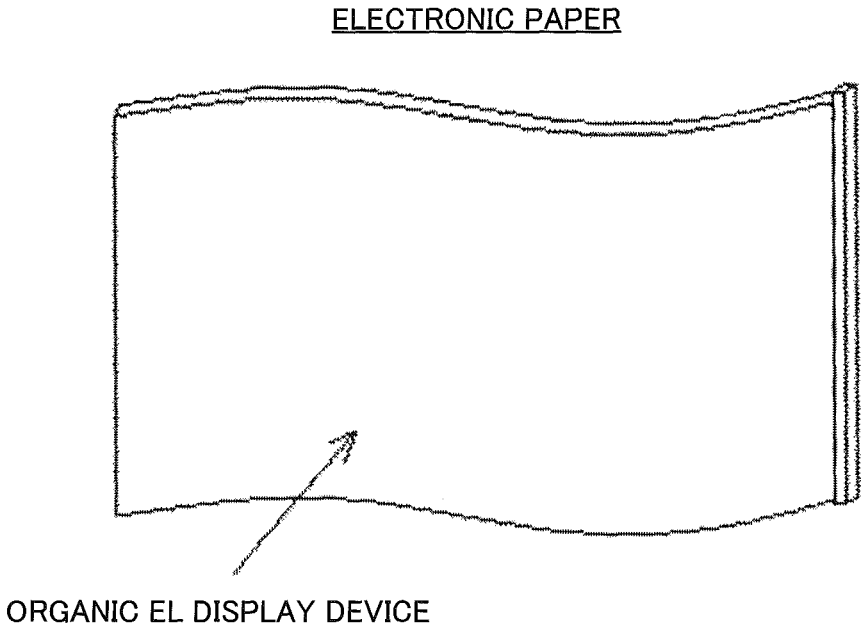
FIG. 38 is a schematic view illustrating another application example of an organic EL display device according to the third example.

Furthermore, the organic EL display device may also be utilized for an electronic paper as illustrated in FIG. 38. For example, the image data or video data, stored in a storage unit located at an end of an electronic paper may be displayed on the organic EL display device, or the image data or video data received through an interface means located at an end of the electronic paper (e.g., a wired communication unit such as universal serial bus (USB) or a wireless communication unit which operates in accordance with a standard such as Ethernet®, fiber-distributed data interface (FDDI) or Token Ring), may be displayed on the organic EL display device.

Figure 39:
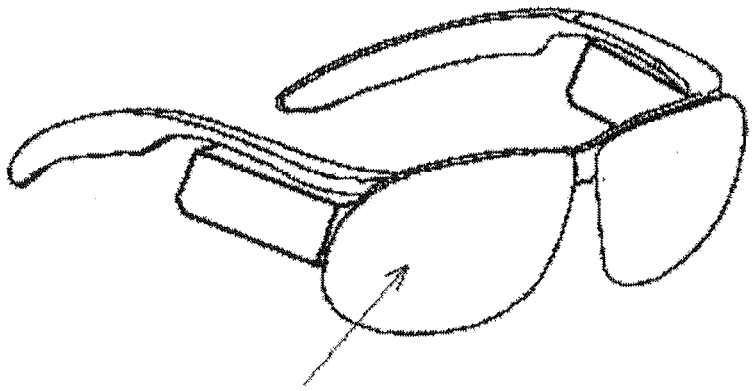
FIG. 39 is a schematic view illustrating another application example of an organic EL display device according to the third example.

Moreover, the organic EL display device may also be utilized for the display unit of a glass-type electronic apparatus to be attached to a face, as illustrated in FIG. 39. For example, the image data or video data stored in a storage unit located at a temple of eyeglasses, sunglasses, goggles or the like may be displayed on the organic EL display device, or the image data or video data received through an interface means located at the temple (e.g., wire communication unit such as USB, short-distance wireless communication unit which operates in accordance with a standard such as Bluetooth® or NFC, or mobile communication unit for communicating through a mobile communication network such as long term evolution (LTE)/3G), may be displayed on the organic EL display device.

It is to be understood that the present invention is not limited to the examples described above, but may appropriately be modified for the type or structure of the electro optical device, material of each component, fabrication method and the like without departing from the spirit of the present invention.

Furthermore, the electro optical device is not limited to the organic EL display device as described in the embodiment and examples. Also, the substrate which constitutes pixels is not limited to the TFT substrate as described in the embodiment and examples. The substrate which constitutes pixels may also be applicable to a passive substrate, not limited to an active substrate. Further, though a circuit constituted by an M1 switch TFT 108*a*, an M2 drive TFT 108*b* and a retention capacitance part 109 (so-called 2T1C circuit) has been illustrated as a circuit to control pixels, a circuit including three or more transistors (e.g., 3T1C circuit) may also be employed.

The present invention is applicable to an electro optical device such as an organic EL display device including a pixel array constituted by four subpixels of four colors in which one color of RGB is divided into two similar colors, an electric apparatus which utilizes the electro optical device as a display device and a pixel rendering method in the pixel arrangement structure.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A pixel rendering method in an electro optical device comprising a pixel array constituted by pixels arranged in matrix, each pixel including four subpixels, the four subpixels including subpixels of colors of R (Red), G (Green) and B (Blue), and a subpixel of a similar color to a specific color, the specific color being a color of subpixel including a light emitting material having a shortest lifetime among the light emitting materials included in the subpixels of colors of R, G and B, respectively, and the four subpixels being arranged in two rows and two columns, and each of the pixels including: a first subpixel having a highest emission luminance and a second subpixel having a second highest emission luminance among subpixels needed to display a white color, both the first subpixel and the second subpixel being arranged on one diagonal line of the pixel; and a third subpixel having a third highest emission luminance and a fourth subpixel having a lowest emission luminance, both the third subpixel and the fourth subpixel being arranged on another diagonal line of the pixel, wherein the method comprises:

extracting a corner, a straight line, a boundary, or a dot which is to be displayed in the pixel array; and making a subpixel emit light with a predetermined value of luminance, the subpixel being in an adjacent pixel located adjacent to the first subpixel or the fourth subpixel within each pixel arranged at the corner, the straight line, the boundary, or the dot, and the adjacent pixel being not located at the corner, the straight line, the boundary, or the dot.

2. The pixel rendering method according to claim 1, comprising in a case where the image is a white dot, making at least one of the first subpixel and the second subpixel in the adjacent pixel emit light, the at least one of the first subpixel and the second subpixel in the adjacent pixel being adjacent to the fourth subpixel in a pixel of the white dot.

3. The pixel rendering method according to claim 2, wherein the adjacent pixel comprises the pixel being adjacent in the fourth subpixel of the pixel of the white dot in a row direction, and the pixel being adjacent to the fourth subpixel of the pixel of the white dot in a column direction, and the method comprises making the first subpixel and the second subpixel adjacent to the fourth subpixel of the pixel of the white dot among the subpixels of the adjacent pixel emit light with different values of luminance from each other.

4. The pixel rendering method according to claim 1, comprising in a case where the image is a white dot, making at least one of the fourth subpixel and the third subpixel in the adjacent pixel emit light, the at least one of the fourth subpixel and the third subpixel in the adjacent pixel being adjacent to the first subpixel in a pixel of the white dot.

5. The pixel rendering method according to claim 4, wherein the adjacent pixel comprises the pixel being adjacent to the first subpixel of the pixel of the white dot in a row direction, and the pixel being adjacent to the first subpixel of the pixel of the white dot in a column direction, and the method comprises making the fourth subpixel and the third subpixel adjacent to the first subpixel of the pixel of the white dot among the subpixels of the adjacent pixel emit light with different values of luminance from each other.

6. The pixel rendering method according to claim 1, comprising in a case where the image is a white line having a width of one pixel, making the first subpixel or the second subpixel in the adjacent pixel outside the white line emit light, the first or second subpixel in the adjacent pixel being adjacent to the fourth subpixel in each pixel inside the white line, and making the second subpixel or the first subpixel in the adjacent pixel outside the white line emit light, the second or first subpixel in the adjacent pixel being adjacent to the third subpixel in the each pixel inside the white line.

7. The pixel rendering method according to claim 1, comprising in a case where the image is a white line having a width of one pixel, making the fourth subpixel or the third subpixel in the adjacent pixel outside the white line emit light, the fourth or third subpixel in the adjacent pixel being adjacent to the first subpixel in each pixel inside the white line, and making the third subpixel or the fourth subpixel in the adjacent pixel outside the white line emit light, the third or fourth subpixel in the adjacent pixel being adjacent to the second subpixel in the each pixel inside the white line.

8. The pixel rendering method according to claim 1, wherein the specific color is deep blue (B2) and the similar color is light blue (B1).

9. The pixel rendering method according to claim 1, comprising in a case where the image is a white line having a width of two or more pixels, making the first subpixel or the second subpixel in the adjacent pixel outside the white line emit light, the first or second subpixel in the adjacent pixel being adjacent to the fourth subpixel in each pixel located at an edge of the white line, and making the second subpixel or the first subpixel in the adjacent pixel outside the white line emit light, the second or first subpixel in the adjacent pixel being adjacent to the third subpixel in the each pixel located at the edge of the white line.

10. The pixel rendering method according to claim 1, comprising in a case where the image is a white line having a width of two or more pixels, making the fourth subpixel or the third subpixel in the adjacent pixel outside the white line emit light, the fourth or third subpixel in the adjacent pixel being adjacent to the first subpixel in each pixel located at an edge of the white line, and making the third subpixel or the fourth subpixel in the adjacent pixel outside the white line emit light, the third or fourth subpixel in the adjacent pixel being adjacent to the second subpixel in the each pixel located at the edge of the white line.

* * * * *